US010777895B2

(12) United States Patent
Paulotto et al.

(10) Patent No.: US 10,777,895 B2
(45) Date of Patent: Sep. 15, 2020

(54) MILLIMETER WAVE PATCH ANTENNAS

(71) Applicant: Apple Inc., Cupertino, CA (US)

(72) Inventors: Simone Paulotto, Redwood City, CA (US); Basim H. Noori, San Jose, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 204 days.

(21) Appl. No.: 15/650,689

(22) Filed: Jul. 14, 2017

(65) Prior Publication Data

US 2019/0020114 A1 Jan. 17, 2019

(51) Int. Cl.
*H01Q 9/04* (2006.01)
*H01Q 1/52* (2006.01)
(Continued)

(52) U.S. Cl.
CPC ..... *H01Q 9/0442* (2013.01); *H01Q 1/521* (2013.01); *H01Q 5/378* (2015.01); *H01Q 5/40* (2015.01); *H01Q 9/40* (2013.01)

(58) Field of Classification Search
CPC .. H01Q 1/2258; H01Q 1/2266; H01Q 1/2275; H01Q 1/24; H01Q 1/241;
(Continued)

(56) References Cited

U.S. PATENT DOCUMENTS 7,595,759 B2 9/2009 Schlub et al.
7,688,265 B2 * 3/2010 Irion, II ..... H01Q 9/0414 343/700 MS
(Continued)

FOREIGN PATENT DOCUMENTS

JP 2017085289 A 5/2017
KR 101014347 B1 2/2011

OTHER PUBLICATIONS

Mudavath Sreenu, Design and Analysis of Dielectric Resonator Antenna, Department of Electronics and Communication Engineering, National Institute of Technology Rourkela, May 20, 2013, pp. 1-75.
(Continued)

*Primary Examiner* — Daniel Munoz
*Assistant Examiner* — Patrick R Holecek
(74) *Attorney, Agent, or Firm* — Treyz Law Group, P.C.; Michael H. Lyons

(57) ABSTRACT

An electronic device may include a millimeter wave antenna having a ground plane, resonating element, feed, and parasitic element. The resonating element may include first, second, and third layer of traces that are shorted together. The second traces may be interposed between the first and third traces and the third traces may be interposed between the second traces and the parasitic. The third traces may have a width that is less than the widths of the second and third traces. The third traces and the parasitic may define a constrained volume having an associated cavity resonance that lies outside of a frequency band of interest. If desired, the resonating element may include a single layer of conductive traces having a grid of openings that disrupt impedance in a transverse direction, thereby mitigating the trapping of energy within the frequency band of interest between the resonating element and the parasitic.

19 Claims, 16 Drawing Sheets

(51) Int. Cl.
*H01Q 5/378* (2015.01)
*H01Q 5/40* (2015.01)
*H01Q 9/40* (2006.01)

(58) Field of Classification Search
CPC ..... H01Q 1/242; H01Q 1/243; H01Q 1/521; H01Q 9/0414; H01Q 9/0442; H01Q 9/045; H01Q 3/01; H01Q 3/24; H01Q 3/247; H01Q 5/30; H01Q 5/307; H01Q 5/378; H01Q 5/40; H01Q 21/065; H01Q 21/08; H01Q 21/29; H01Q 21/293; H01Q 21/30
See application file for complete search history.

(56) References Cited

U.S. PATENT DOCUMENTS

| | | | | |
|---|---|---|---|---|
| 7,855,696 | B2 * | 12/2010 | Gummalla | H01Q 1/243 342/359 |
| 8,102,330 | B1 | 1/2012 | Albers | |
| 8,872,711 | B2 | 10/2014 | Parsche | |
| 9,172,143 | B2 | 10/2015 | Tang | |
| 2005/0110685 | A1 | 5/2005 | Frederik du Toit | |
| 2006/0267844 | A1 | 11/2006 | Yanagi et al. | |
| 2008/0316121 | A1 | 12/2008 | Hobson et al. | |
| 2014/0203995 | A1 | 7/2014 | Romney et al. | |
| 2014/0210486 | A1 | 7/2014 | Dijkstra | |
| 2015/0194730 | A1 | 7/2015 | Sudo et al. | |
| 2015/0207233 | A1 | 7/2015 | Kim et al. | |
| 2015/0333407 | A1 | 11/2015 | Yamagajo et al. | |
| 2017/0062937 | A1 * | 3/2017 | Ganchrow | H01Q 9/0421 |
| 2017/0110787 | A1 | 4/2017 | Ouyang et al. | |
| 2017/0149127 | A1 | 5/2017 | Li et al. | |
| 2017/0256867 | A1 | 9/2017 | Ding et al. | |
| 2018/0159203 | A1 * | 6/2018 | Baks | H01Q 1/2283 |
| 2018/0198204 | A1 | 7/2018 | Kovacic | |

OTHER PUBLICATIONS

Basim H. Noori et al., U.S. Appl. No. 14/921,895, filed Oct. 23, 2015.
Yuehui Ouyang et al., U.S. Appl. No. 14/883,495, filed Oct. 14, 2015.
Basim Noori et al., 15/138,684, filed Apr. 26, 2016.
Basim H. Noori et al., U.S. Appl. No. 15/138,689, filed Apr. 26, 2016.
Matthew A. Mow et al., U.S. Appl. No. 15/217,805, filed Jul. 22, 2016.
Simone Paulotto et al., U.S. Appl. No. 15/650,638, filed Jul. 14, 2017.
Simone Paulotto et al., U.S. Appl. No. 15/650,627, filed Jul. 14, 2017.

* cited by examiner

MILLIMETER WAVE PATCH ANTENNAS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high data rates, but may raise significant challenges. For example, millimeter wave communications are often line-of-sight communications and can be characterized by substantial attenuation during signal propagation. In addition, it can be difficult to support millimeter wave communications over a sufficiently wide frequency bandwidth.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include one or more antennas and transceiver circuitry such as millimeter wave transceiver circuitry. The millimeter wave transceiver circuitry may convey millimeter wave signals within a millimeter wave communications band of interest using the antenna. The antenna may include an antenna ground plane, a patch antenna resonating element, an antenna feed, and a parasitic antenna resonating element. The antenna feed may include a first feed terminal coupled to the antenna resonating element and a second feed terminal coupled to the ground plane. If care is not taken, the parasitic antenna resonating element and the antenna resonating element may define a volume having a corresponding cavity resonance that serves to trap millimeter wave signals within the volume.

If desired, the antenna resonating element may be formed from conductive traces on multiple dielectric layers. For example, the antenna may be embedded on a stacked dielectric substrate having at least first, second, and third layers stacked over the antenna ground plane. The antenna resonating element may include first traces on the first layer, second traces on the second layer, and third traces on the third layer that are shorted together using vertical conductive interconnects such as sets of conductive vias. The second traces may be interposed between the first and third traces and the third traces may be interposed between the second traces and the parasitic antenna resonating element. The third traces may have a width that is less than the widths of the second and third traces. The third traces and the parasitic antenna resonating element may define a volume having an associated cavity resonance. Constraining the cavity resonance to the volume between the third traces and the parasitic element may serve to shift the cavity resonance to frequencies that are outside of the millimeter wave communications band of interest, thereby preventing the trapping of millimeter wave signals between the parasitic element and the antenna resonating element within the millimeter wave communications band of interest.

If desired, the antenna resonating element may be formed from conductive traces on a single dielectric layer. The volume between the single layer of conductive traces and the parasitic element may exhibit a corresponding cavity resonance. In this scenario, a grid of openings may be formed in the conductive traces. The openings may be sufficiently narrow so as to allow antenna currents to flow across the lateral area of the antenna resonating element. At the same time, the openings may serve to disrupt antenna impedance in a transverse direction between the parasitic element and the antenna resonating element, thereby reducing the magnitude of the cavity resonance and the corresponding trapping of millimeter wave signals between the parasitic element and the antenna resonating element. By mitigating the trapping of millimeter wave signals within the volume between the parasitic element and the antenna resonating element, the antenna may exhibit satisfactory antenna efficiency over the entire millimeter wave communications band of interest.

DETAILED DESCRIPTION

Figure 1:
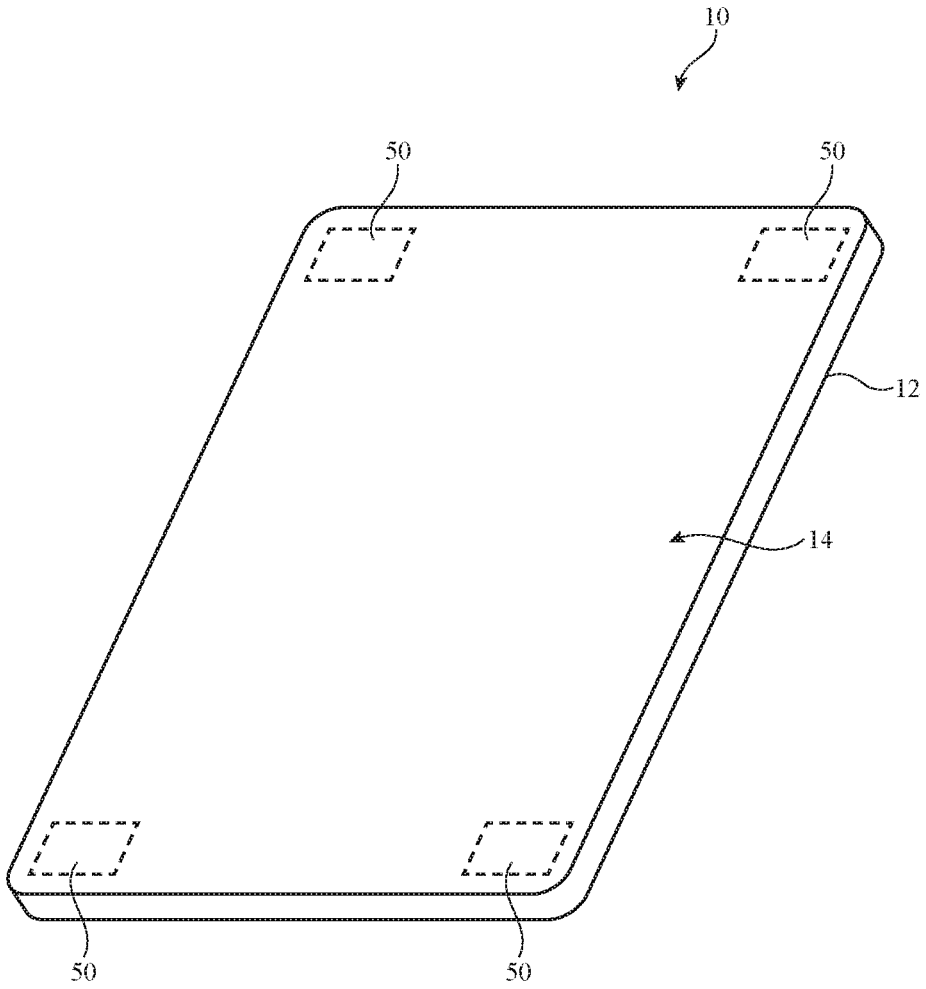
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Antennas within electronic device 10 may include stacked patch antennas for handling communications at frequencies between 10 GHz and 300 GHz. A stacked patch antenna may include an antenna resonating element and a parasitic antenna resonating element formed over the antenna resonating element. If care is not taken, electromagnetic energy can be trapped between the antenna resonating element and the parasitic antenna resonating element, thereby decreasing the overall antenna efficiency. In order to mitigate this trapping, in one suitable arrangement, the antenna resonating element may be formed from multiple layers of conductive traces that are shorted together. This may serve to alter the volume between the antenna resonating element and the parasitic antenna resonating element, thereby mitigating trapping of electromagnetic energy between the antenna resonating element and the parasitic antenna resonating element within a frequency band of interest. In another suitable arrangement, slots may be formed in the antenna resonating element and the parasitic antenna resonating element to divide the antenna resonating element into a first set of coplanar segments and to divide the parasitic antenna resonating element into a second set of coplanar segments. This may serve to alter the electromagnetic boundary conditions defined by the parasitic antenna resonating element and the antenna resonating element, thereby mitigating trapping of electromagnetic energy between the antenna resonating element and the parasitic antenna resonating element within a frequency band of interest.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
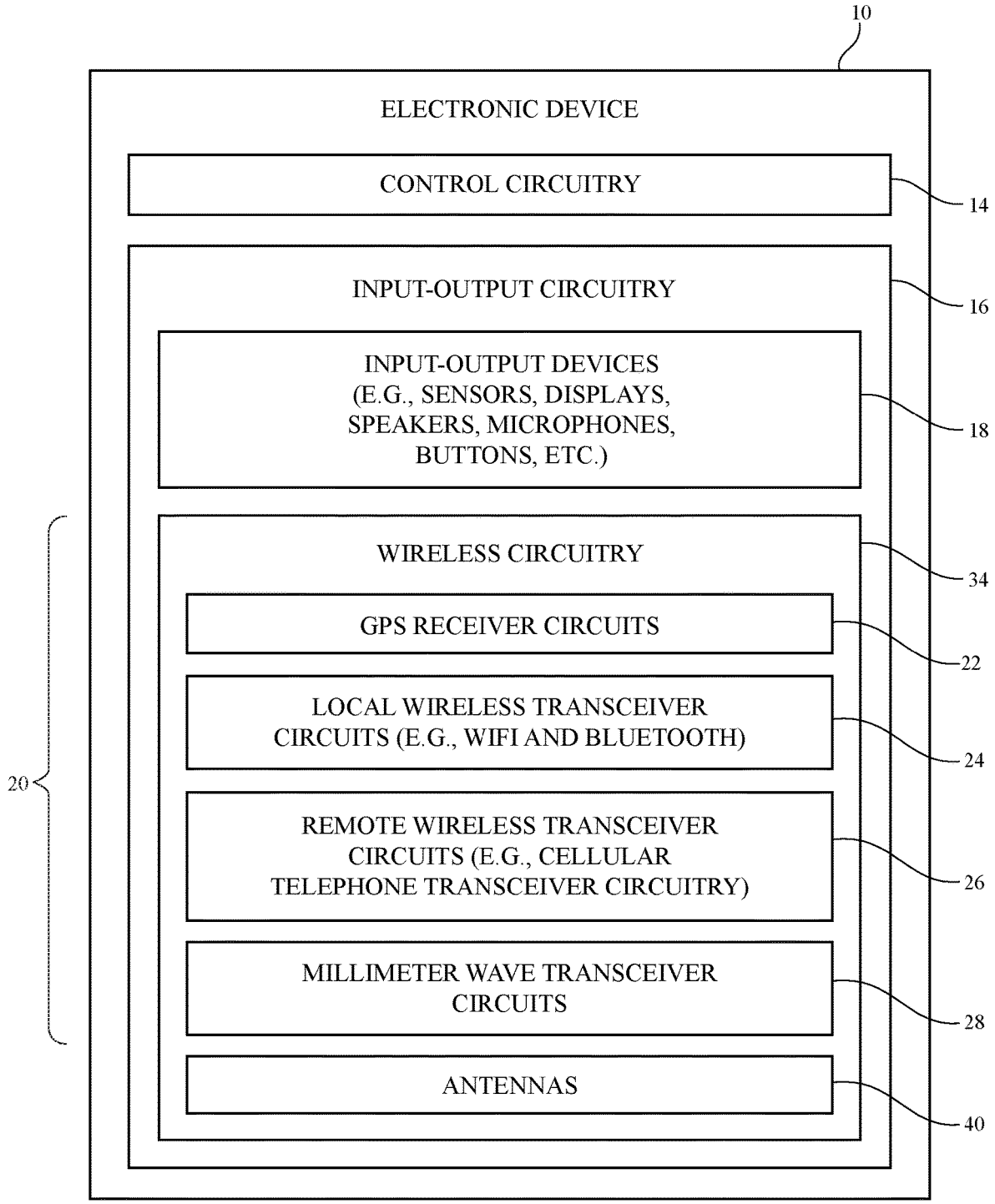
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, non-volatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metalized vias, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
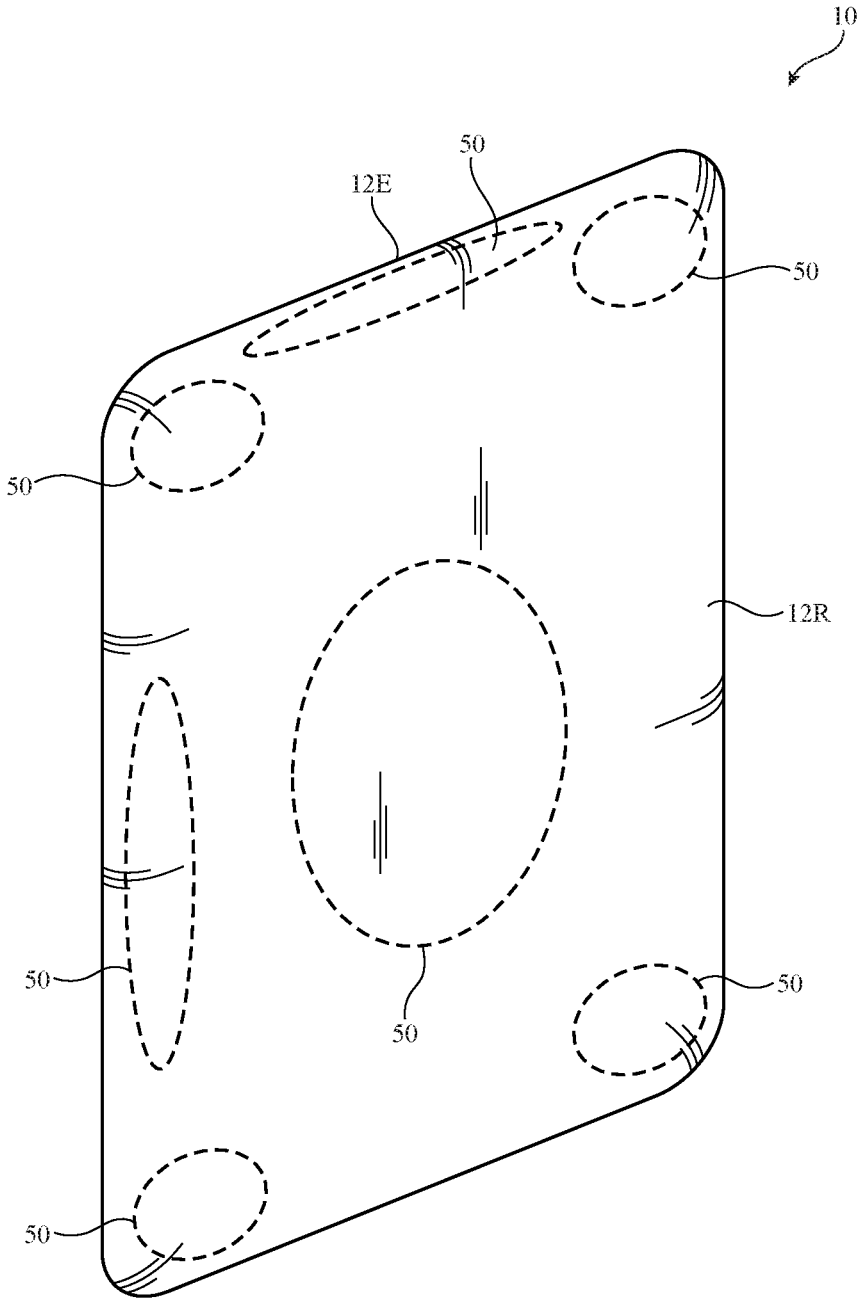
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. If desired, each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
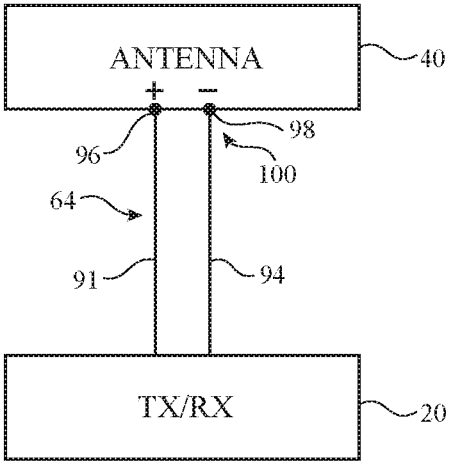
FIG. 4 is a diagram of an illustrative transceiver circuit and antenna in accordance with an embodiment.

A schematic diagram of an antenna 40 coupled to transceiver circuitry 20 (e.g., transceiver circuitry 28) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may include a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Transmission line paths such as path 64 may be used to route antenna signals within device 10. For example, transmission line paths may be used to couple antenna structures such as one or more antennas in an array of antennas to transceiver circuitry 20. Transmission lines in device 10 may include coaxial probes realized by metal vias, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals wireless transceiver circuits 28 may be implemented as phased antenna arrays. The radiating elements in a phased antenna array for supporting millimeter and centimeter wave communications may be patch antennas (e.g., stacked patch antennas), dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules.

Figure 5:
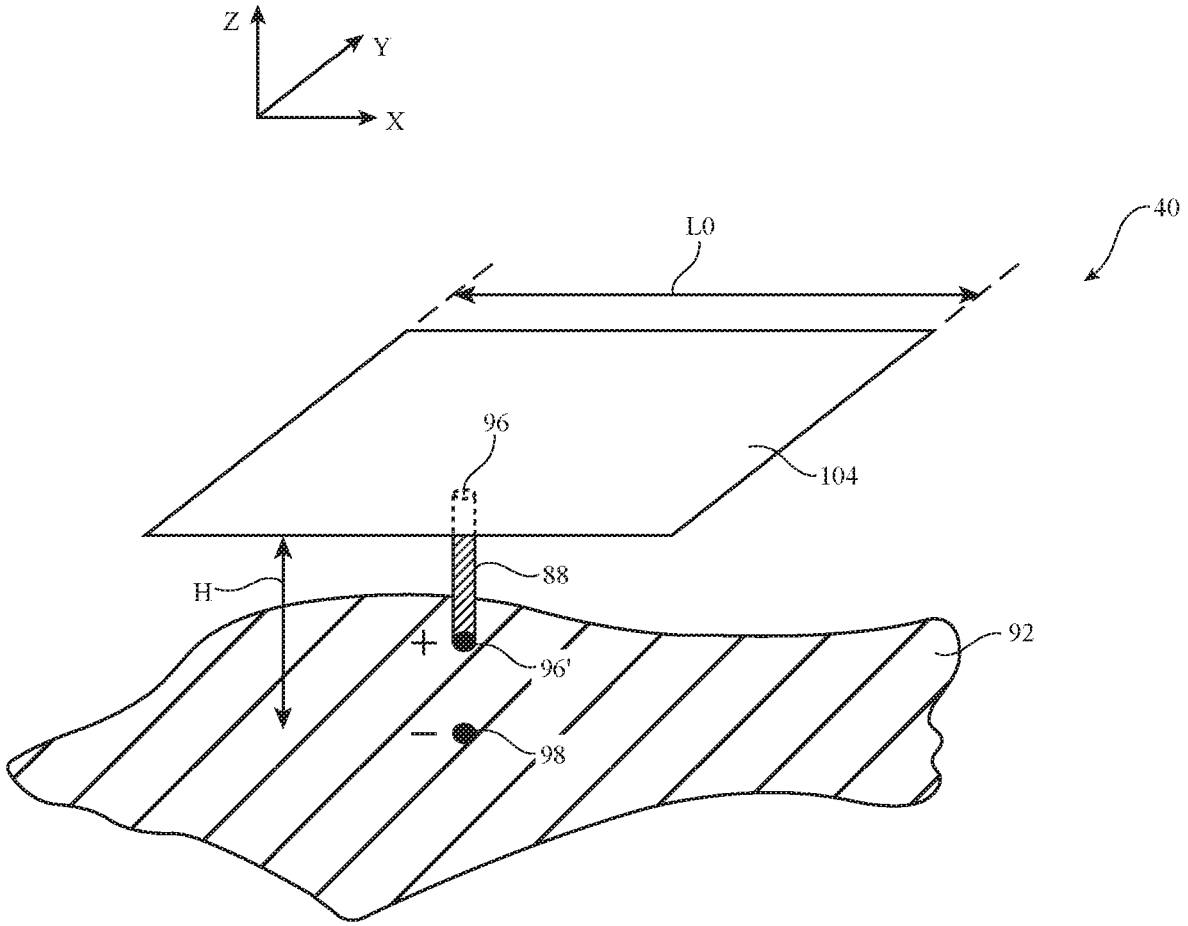
FIG. 5 is a perspective view of an illustrative patch antenna in accordance with an embodiment.

An illustrative patch antenna that may be used in conveying wireless signals at frequencies between 10 GHz and 300 GHz or other wireless signals is shown in FIG. 5. As shown in FIG. 5, patch antenna 40 may have a patch antenna resonating element 104 that is separated from and parallel to a ground plane such as antenna ground plane 92. Positive antenna feed terminal 96 may be coupled to patch antenna resonating element 104. Ground antenna feed terminal 98 may be coupled to ground plane 92. If desired, conductive path 88 (e.g., a coaxial probe feed) may be used to couple terminal 96' to terminal 96 so that antenna 40 is fed using a transmission line with a positive conductor coupled to terminal 96' and thus terminal 96. If desired, path 88 may be omitted and other types of antenna feed arrangements may be used. The illustrative feeding configuration of FIG. 5 is merely illustrative.

As shown in FIG. 5, patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground 92 may lie within a plane that is parallel to the plane of patch 104. Patch 104 and ground 92 may therefore lie in separate parallel planes that are separated by a distance H. Patch 104 and ground 92 may be formed from conductive traces patterned on a dielectric substrate such as a rigid or flexible printed circuit board substrate, metal foil, stamped sheet metal, electronic device housing structures, or any other desired conductive structures. The length of the sides of patch 104 may be selected so that antenna 40 resonates at a desired operating frequency. For example, the sides of element 104 may each have a length L0 that is approximately equal to half of the wavelength (e.g., within 15% of half of the wavelength) of the signals conveyed by antenna 40 (e.g., in scenarios where patch element 104 is substantially square).

The example of FIG. 5 is merely illustrative. Patch 104 may have a square shape in which all of the sides of patch 104 are the same length or may have a different rectangular shape. If desired, patch 104 and ground 92 may have different shapes and orientations (e.g., planar shapes, curved patch shapes, patch shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension that is approximately equal to (e.g., within 15% of) half of the wavelength of operation, for example.

Figure 6:
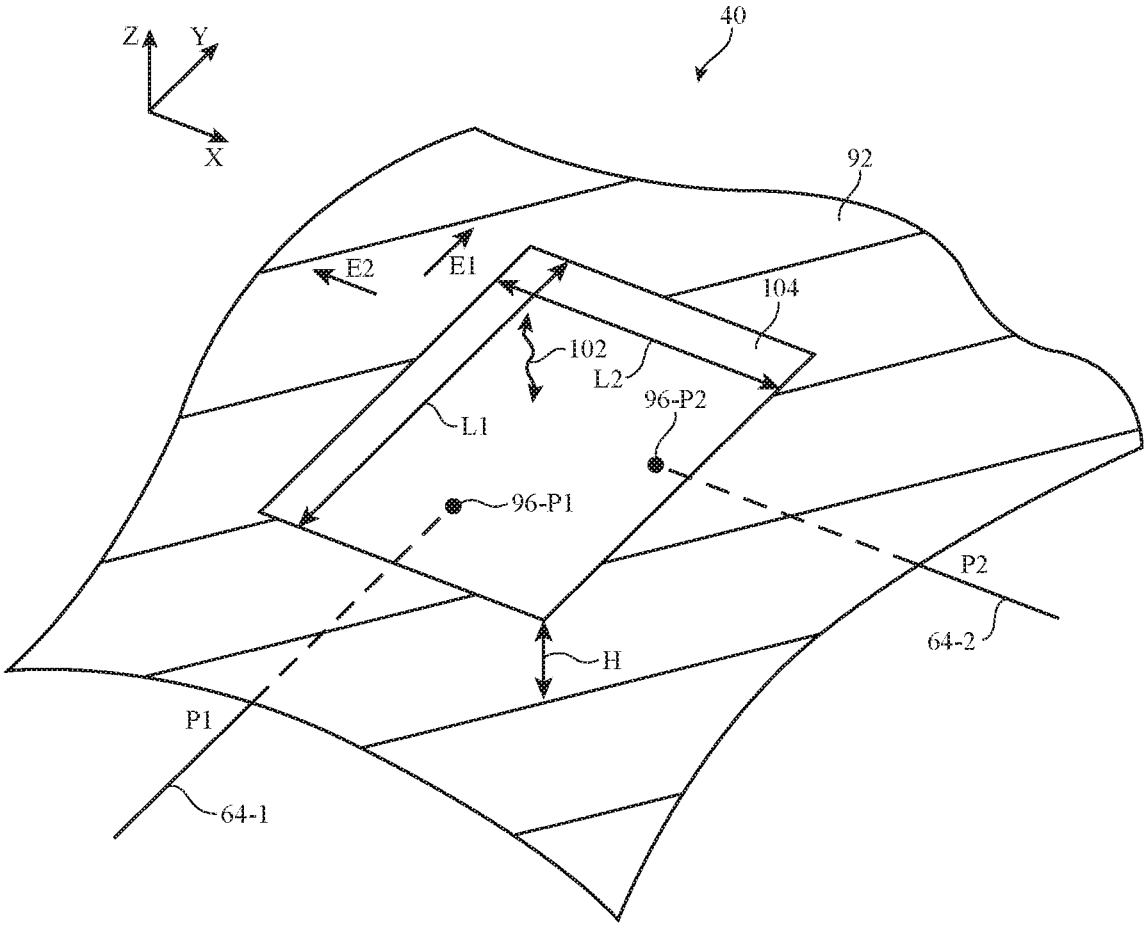
FIG. 6 is a perspective view of an illustrative patch antenna with dual ports in accordance with an embodiment.

To enhance the polarizations handled by patch antenna 40, antenna 40 may be provided with multiple feeds. An illustrative patch antenna with multiple feeds is shown in FIG. 6. As shown in FIG. 6, antenna 40 may have a first feed at antenna port P1 that is coupled to transmission line 64-1 and a second feed at antenna port P2 that is coupled to transmission line 64-2. The first antenna feed may have a first ground feed terminal coupled to ground 92 and a first positive feed terminal 96-P1 coupled to patch 104. The second antenna feed may have a second ground feed terminal coupled to ground 92 and a second positive feed terminal 96-P2 on patch 104.

Patch 104 may have a rectangular shape with a first pair of edges running parallel to dimension Y and a second pair of perpendicular edges running parallel to dimension X, for example. The length of patch 104 in dimension Y is L1 and the length of patch 104 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 102 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 102 associated with port P2 may be oriented parallel to dimension X so that the polarizations associated with ports P1 and P2 are orthogonal to each other). In scenarios where patch 104 is square (e.g., length L1 is equal to length L2), ports P1 and P2 may cover the same communications band. In scenarios where patch 104 is rectangular, ports P1 and P2 may cover different communications bands if desired. During wireless communications using device 10, device 10 may use port P1, port P2, or both port P1 and P2 to transmit and/or receive signals (e.g., millimeter wave signals at millimeter wave frequencies).

The example of FIG. 6 is merely illustrative. Patch 104 may have a square shape in which all of the sides of patch 104 are the same length or may have a rectangular shape in which length L1 is different from length L2. In general, patch 104 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

If care is not taken, antennas 40 such as single-polarization patch antennas of the type shown in FIG. 5 and/or dual-polarization patch antennas of the type shown in FIG. 6 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch antenna resonating element 104 as shown in FIGS. 5 and 6 may have insufficient bandwidth to cover the entirety of the frequency range between 57 GHz and 71 GHz. If desired, antenna 40 may include one or more parasitic antenna resonating elements that serve to broaden the bandwidth of antenna 40.

Figure 7:
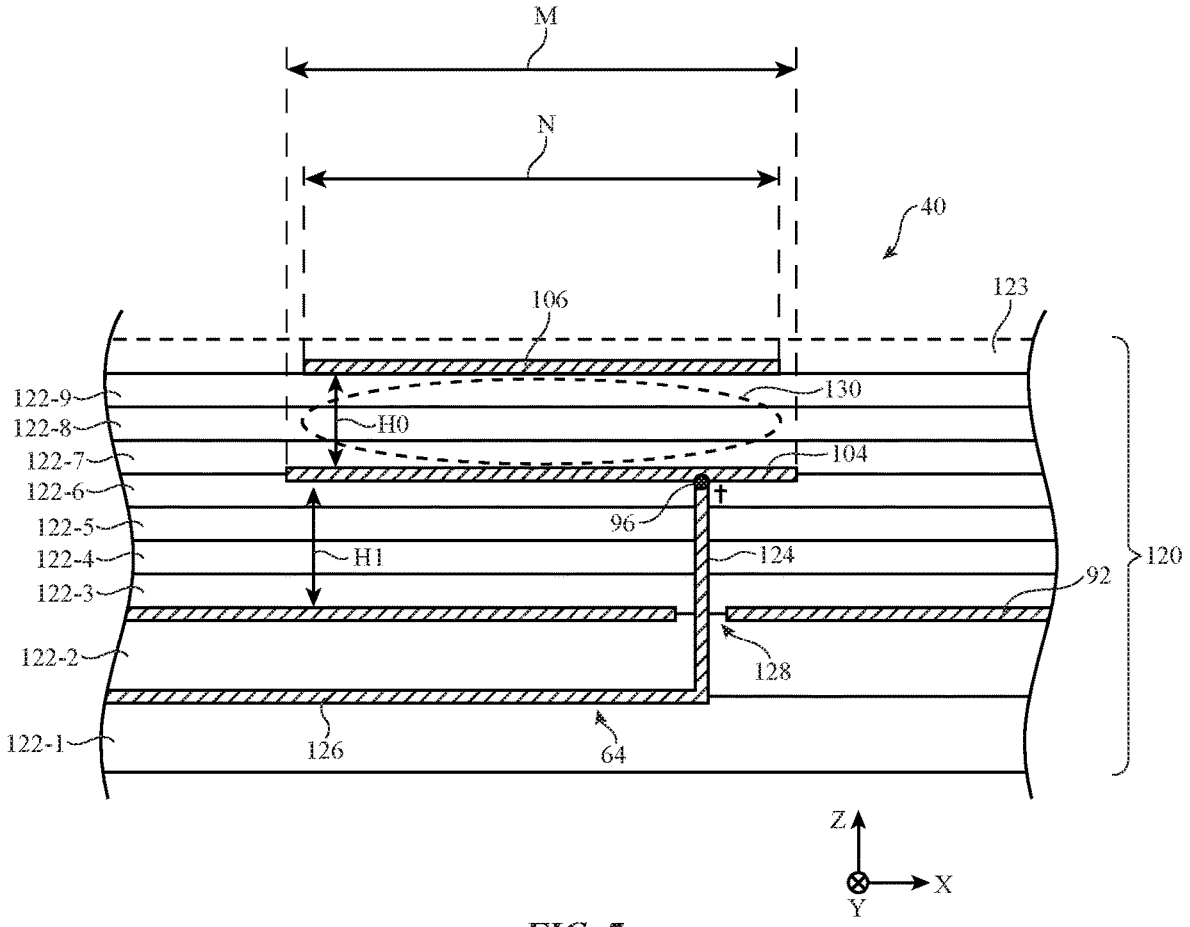
FIG. 7 is a cross-sectional side view of an illustrative patch antenna having a parasitic element in accordance with an embodiment.

FIG. 7 is a cross-sectional side view showing how antenna 40 may be provided with a bandwidth widening parasitic antenna resonating element. As shown in FIG. 7, antenna 40 may be formed on a dielectric substrate such as substrate 120. Substrate 120 may be, for example, a rigid or printed circuit board or other dielectric substrate. Substrate 120 may include multiple stacked dielectric layers 122 (e.g., multiple layers of printed circuit board substrate such as multiple layers of fiberglass-filled epoxy) such as a first dielectric layer 122-1, a second dielectric layer 122-2 over the first dielectric layer, a third dielectric layer 122-3 over the second dielectric layer, a fourth dielectric layer 122-4 over the third dielectric layer, a fifth dielectric layer 122-5 over the fourth dielectric layer, a sixth dielectric layer 122-6 over the fifth dielectric layer, a seventh dielectric layer 122-7 over the sixth dielectric layer, an eighth dielectric layer 122-8 over the seventh dielectric layer, and a ninth dielectric layer 122-9 over the eighth dielectric layer. Each layer 122 may have the same thickness (height) or two or more layers 122 may have different thicknesses. Additional dielectric layers 122 may be stacked within substrate 120 if desired.

With this type of arrangement, antenna 40 may be embedded within the layers of substrate 120. For example, ground plane 92 may be formed on a surface of second layer 122-2 whereas resonating element 104 of antenna 40 is formed on a surface of sixth layer 122-6. Antenna 40 may be fed using a transmission line 64 and an antenna feed that includes positive antenna feed terminal 96 coupled to resonating element 104 and a ground antenna feed terminal coupled to ground plane 92. Transmission line 64 may, for example, be formed from a conductive trace such as conductive trace 126 on a surface of first layer 122-1 and portions of ground layer 92. Conductive trace 126 may form the positive signal conductor for transmission line 64 (e.g., positive signal conductor 91 as shown in FIG. 4).

A hole or opening 128 may be formed in ground layer 92. Transmission line 64 may include a vertical conductor 124 (e.g., a conductive through-via, conductive pin, metal pillar, solder bump, combinations of these, or other vertical conductive interconnect structures) that extends from trace 126 through layer 122-2, opening 128 in ground layer 92, and layers 122-3 through 122-6 to feed terminal 96 on resonating element 104. This example is merely illustrative and, if desired, other transmission line structures may be used (e.g., coaxial cable structures, stripline transmission line structures, etc.).

As shown in FIG. 7, one or more dielectric layers such as dielectric layers 122-7 through 122-9 may be formed over patch antenna resonating element 104. A bandwidth widening parasitic antenna resonating element such as element 106 may be formed from conductive traces on a surface of layer 122-9. Parasitic antenna resonating element 106 may sometimes be referred to herein as parasitic resonating element 106, parasitic antenna element 106, parasitic element 106, parasitic patch 106, parasitic conductor 106, parasitic structure 106, or patch 106. Parasitic element 106 is not directly fed, whereas patch antenna resonating element 104 is directly fed via transmission line 64 and feed terminal 96. Parasitic element 106 may create a constructive perturbation of the electromagnetic field generated by patch antenna resonating element 104, creating a new resonance for antenna 40. This may serve to broaden the overall bandwidth of antenna 40 (e.g., to cover the entire millimeter wave frequency band from 57 GHz to 71 GHz).

Parasitic element 106 may be located at a distance H0 with respect to patch antenna resonating element 104 (e.g., distance H0 may be equal to the sum of the thicknesses of layers 122-7, 122-8, and 122-9). Patch antenna resonating element 104 may be located at a distance H1 with respect to ground plane 92 (e.g., distance H1 may be equal to the sum of the thicknesses of layers 12-3, 122-4, and 122-5). Distance H1 may be equal to, less than, or greater than distance H0. In practice, distances H1 and H0 may be adjusted to adjust the overall bandwidth of antenna 40.

Patch antenna resonating element 104 may have a width M. As examples, patch element 104 may be a rectangular patch (e.g., as shown in FIGS. 5 and 6) having a side of length M, a square patch having four sides of length M, a circular patch having diameter M, an elliptical patch having a major axis length M, or may have any other desired shape (e.g., where length M is the maximum lateral dimension of the patch, a length of a side of the patch such as the longest side of the patch, a length of a side of a rectangular footprint of the patch, etc.). The size of width M may be selected so that antenna 40 resonates at a desired operating frequency. For example, width M may be approximately equal to half of the wavelength (e.g., within 15% of half of the wavelength) of the signals conveyed by antenna 40 or less than this by a factor determined by the dielectric constant of substrate 120 (e.g., the dielectric constant of layers 122-1 through 122-9). For example, in scenarios where the dielectric constant of substrate 120 is $\varepsilon_R$, width M may be approximately equal to (e.g., within 15% of) the wavelength of operation of antenna 40 divided by two times the square root of $\varepsilon_R$. As examples, dielectric constant $\varepsilon_R$ may be between 1.0 and 6.0, between 2.0 and 4.0, between 2.5 and 3.5, between 3.0 and 4.0, between 3.4 and 3.7, 3.6, 3.45, 3.5, 3.4, or any other desired value (e.g., depending on the material used in forming substrate 120). In the scenario where antenna 40 covers a millimeter wave frequency band from 57 GHz to 71 GHz, width M may be between 1.0 mm and 1.2 mm, for example.

Parasitic element 106 may have a width N. As examples, parasitic element 106 may be a rectangular patch having a side of length N, a square patch having four sides of length N, a circular patch having diameter N, an elliptical patch having a major axis length N, or may have any other desired shape (e.g., where length N is the maximum lateral dimension of the patch, a length of a side of the patch such as the longest side of the patch, a length of a side of a rectangular footprint of the patch, etc.). Width N may be the same as width M of patch antenna resonating element 104, may be less than width M, or may be greater than width M. If desired, an optional dielectric layer 123 such as a solder mask layer may be formed over parasitic 106 and layer 122-9 of substrate 120. Layer 123 may have a dielectric constant that is different from (e.g., greater than) the dielectric constant of layers 122. Width N may, for example, be approximately equal to the sum of the wavelength of operation of antenna 40 and a constant offset value, the sum being divided by two times the square root of the dielectric constant of layer 123. Layer 123 may be omitted if desired. A volume 130 may be defined between parasitic element 106 and patch antenna resonating element 104.

The example of FIG. 7 is merely illustrative. If desired, fewer or additional layers 122 may be interposed between trace 126 and ground 92, between ground 92 and patch 104, and/or between patch 104 and parasitic element 106. In one suitable arrangement, a single layer 122 is formed between patch 104 and ground 92 and a single layer 122 is formed between patch 104 and parasitic 106. In another suitable arrangement, substrate 120 may be formed from a single dielectric layer (e.g., antenna 40 may be embedded within a single dielectric layer such as a molded plastic layer). In yet another suitable arrangement, substrate 120 may be omitted and antenna 40 may be formed on other substrate structures or may be formed without substrates. If desired, patch element 104 and/or parasitic 106 may be formed from conductive traces on one or more dielectric substrates, metal foil, stamped sheet metal, conductive electronic device housing structures, or any other desired conductive structures within device 10.

Figure 8:
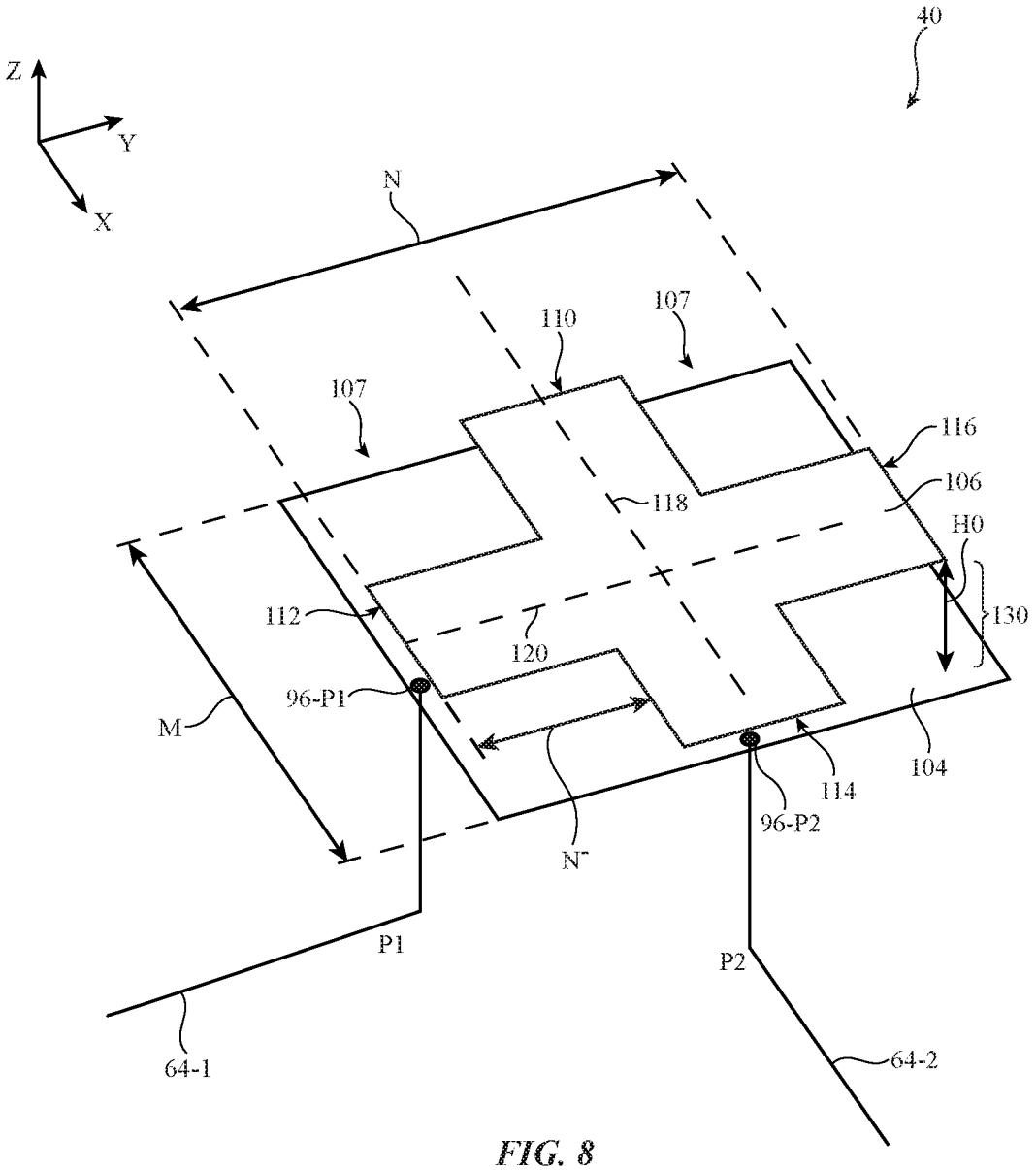
FIG. 8 is a perspective view of an illustrative patch antenna having a parasitic element in accordance with an embodiment.

In the example of FIG. 7, antenna 40 is shown as having only a single polarization (feed) for the sake of clarity. Antenna 40 may, if desired, be a dual-polarized patch antenna having two feeds (e.g., as shown in FIG. 6). FIG. 8 is a perspective view of antenna 40 having parasitic antenna resonating element 106 and two feeds for covering two orthogonal polarizations. In the example of FIG. 8, dielectric substrate 120, dielectric layer 123, and ground plane 92 are not shown for the sake of clarity.

As shown in FIG. 8, antenna 40 may have a first feed at antenna port P1 that is coupled to first transmission line 64-1 and a second feed at antenna port P2 that is coupled to a second transmission line 64-P2. The first antenna feed may have a first ground feed terminal coupled to ground 92 and a first positive feed terminal 96-P1 coupled to patch antenna resonating element 104 at a first location. The second antenna feed may have a second ground feed terminal coupled to ground 92 and a second positive feed terminal 96-P2 coupled to patch antenna resonating element 104 at a second location. Feed terminal 96-P1 may be coupled to patch 104 adjacent to a first side of patch 104 whereas feed terminal 96-P2 is coupled to patch 104 adjacent to a second side of patch 104 that is perpendicular to the first side of patch 104, for example.

Parasitic resonating element 106 may be formed over patch 104. At least some or an entirety of parasitic resonating element 106 may overlap patch 104. In the example of FIG. 8, parasitic resonating element 106 has a cross or "X" shape. In order to form the cross shape, parasitic element 106 may include notches or slots such as slots 107 (e.g., slots formed by removing conductive material from the corners of a square or rectangular metal patch). Cross-shaped parasitic 106 may have a rectangular (e.g., square) outline or footprint. The width N of cross-shaped parasitic element 106 may be defined by the length of a side of the rectangular footprint of element 106, for example.

Cross-shaped parasitic resonating element 106 may include a first arm 110, a second arm 112, a third arm 114, and a fourth arm 116 that extend from the center of element 106. First arm 110 may oppose third arm 114 whereas second arm 112 opposes fourth arm 116 (e.g., arms 110 and 114 may extend in parallel and from opposing sides of the point at the center of element 106 and arms 112 and 116 may extend in parallel and from opposing sides of the point at the center of element 106). Arms 110 and 114 may extend along a first longitudinal axis 118 whereas arms 112 and 116 extend along a second longitudinal axis 120. Longitudinal axis 118 may be oriented at an angle of approximately 90 degrees with respect to axis 120. In the example of FIG. 8, the combined length of arms 110 and 114 is equal to the combined length of arms 112 and 116 (e.g., each of arms 110, 112, 114, and 116 has the same length). This is merely illustrative and, in scenarios where two different linear polarizations are not used, arms 110, 112, 114, and/or 116 may have different lengths.

In a single-polarization patch antenna, the distance between the positive antenna feed terminal 96 and the edge of patch 104 may be adjusted to ensure that there is a satisfactory impedance match between patch 104 and the corresponding transmission line 64. However, such impedance adjustments may not be possible when the antenna is a dual-polarized patch antenna having two feeds. Removing conductive material from parasitic resonating element 106 to form notches 107 may serve to adjust the impedance of patch 104 so that the impedance of patch 104 is matched to both transmission lines 64-1 and 64-2, for example. Notches 107 may therefore sometimes be referred to herein as impedance matching notches, impedance matching slots, or impedance matching structures.

The dimensions of impedance matching notches 107 may be adjusted (e.g., during manufacture of device 10) to ensure that antenna 40 is sufficiently matched to both transmission lines 64-1 and 64-2 and to tweak the overall bandwidth of antenna 40. In order for antenna 40 to be sufficiently matched to transmission lines 64-1 and 64-2, feed terminals 96-1 and 96-2 need to overlap with the conductive material of parasitic element 106. Notches 107 may therefore be sufficiently small so as not to uncover feed terminals 96-1 or 96-2. In other words, each of antenna feed terminals 96-1 and 96-2 may overlap with a respective arm of the cross-shaped parasitic antenna resonating element 106. As an example, notches 107 may have sides with lengths N' that are equal to between 1% and 45% of width N of parasitic 106. In an example where width N is between 1.0 mm and 1.2 mm, length N' may be between 0.3 mm and 0.4 mm. During wireless communications using device 10, device 10 may use ports P1 and P2 to transmit and/or receive millimeter wave signals with two orthogonal linear polarizations.

The example of FIG. 8 is merely illustrative. If desired, parasitic antenna resonating element 106 may have additional notches 107, fewer notches 107, may have curved edges, straight edges, combinations of straight and curved edges, or any other desired shape (e.g., in scenarios where a dual linear polarized patch is not used). Each of notches 107 may have the same shape and dimensions or two or more of notches 107 may have different shapes or dimensions. The edges of parasitic element 106 and/or longitudinal axes 120 and 118 may each be parallel to at least one edge of patch 104. Each arm of parasitic element 106 may have the same width (e.g., as measured perpendicular to the corresponding longitudinal axis). In another scenario, two or more arms may have different widths (e.g., in scenarios where a dual linear polarized patch is not used). Parasitic element 106 may have any desired number of arms. In general, parasitic element 106 may be referred to herein as a cross-shaped parasitic element in any scenario where parasitic element 106 includes at least three arms extending from different sides of a common point on parasitic element 106, where the arms of parasitic element 106 extend along at least two non-parallel longitudinal axes.

When configured in this way, antenna 40 may cover a relatively wide millimeter wave communications band of interest such as a frequency band between 57 GHz and 71 GHz. The millimeter wave communications band of interested may be defined by a lower threshold frequency (e.g., 57 GHz) and an upper threshold frequency (e.g., 71 GHz). Parasitic element 106 and patch antenna resonating element 104 may define boundaries of volume 130 between patch antenna resonating element 104 and parasitic element 106. If care is not taken, antenna 40 may exhibit a cavity resonance within volume 130 at relatively high frequencies such as frequencies around the upper threshold frequency of the millimeter wave communications band of interest. This cavity resonance may serve to trap millimeter wave signals (energy) within volume 130 at these frequencies, thereby reducing the overall antenna efficiency of antenna 40 within the millimeter wave communications band of interest. This reduction in antenna efficiency may introduce errors in the wireless data conveyed by antenna 40 and/or may cause the corresponding millimeter wave communications link to be dropped.

Figure 9:
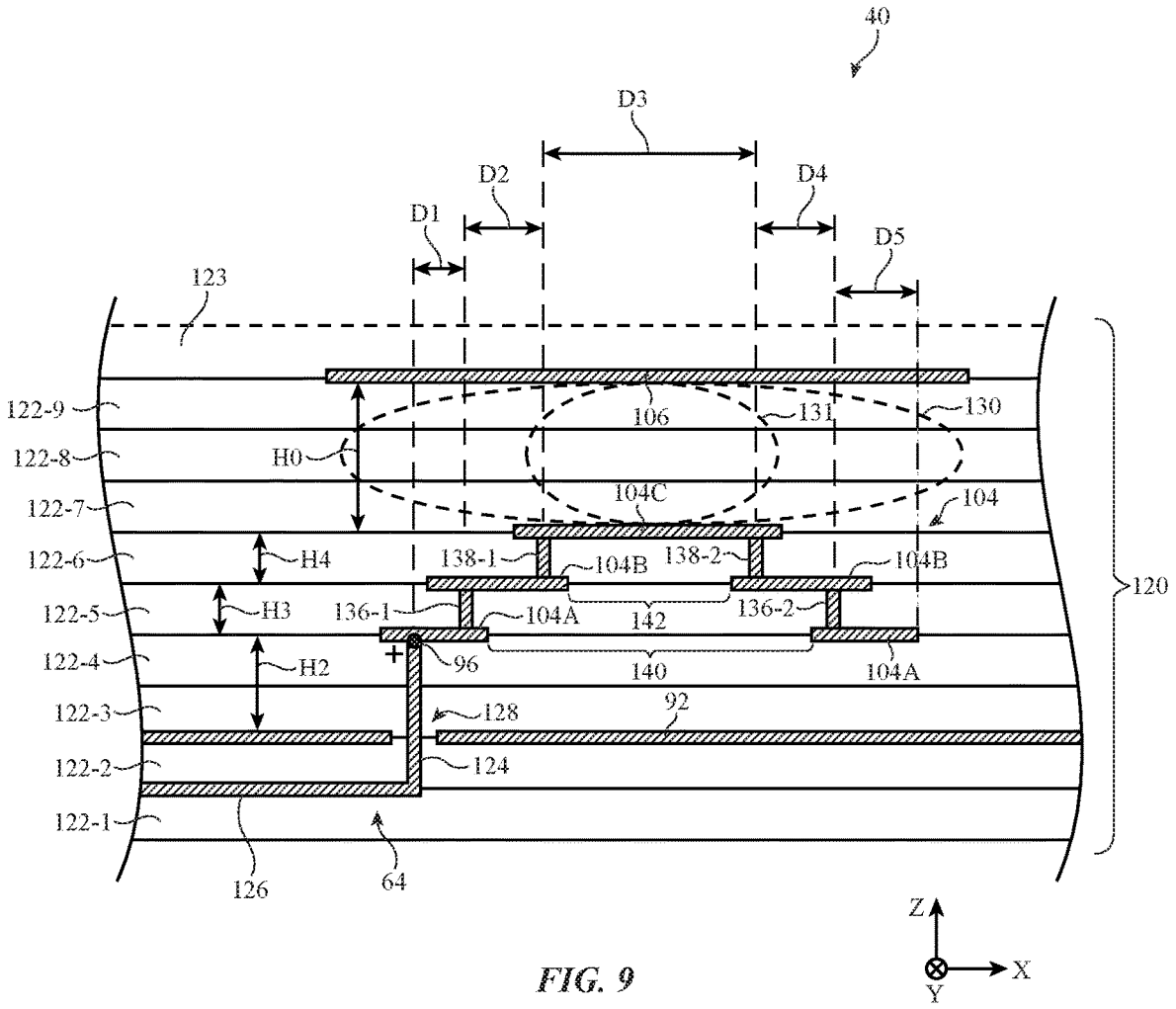
FIG. 9 is a cross-sectional side view of an illustrative patch antenna having a multi-layer antenna resonating element and a parasitic element in accordance with an embodiment.

In order to mitigate the trapping of millimeter wave signals within volume 130 at frequencies in the millimeter wave communications band of interest, in one suitable arrangement, antenna 40 may be provided with a multi-layer patch antenna resonating element. FIG. 9 is cross-sectional side view showing how antenna 40 may include a multi-layer patch antenna resonating element 104.

As shown in FIG. 9, patch antenna resonating element 104 may be formed from multiple layers of conductive traces located at different distances with respect to ground plane 92 (e.g., on different dielectric layers 122 in substrate 120). For example, patch antenna resonating element 104 may include a first portion 104A formed at a distance H2 with respect to ground plane 92, a second portion 104B formed at distance H3 with respect to portion 104A (e.g., distance H3+H2 with respect to ground plane 92), and a third portion 104C formed at distance H4 with respect to portion 104B (e.g., distance H4+H3+H2 with respect to ground plane 92). Portion 104C may be formed at distance H0 with respect to parasitic antenna resonating element 106. First portion 104A may be formed on a corresponding dielectric layer 122 such as dielectric layer 122-4, second portion 104B may be formed on a corresponding dielectric layer 122 such as dielectric layer 122-5, and third portion 104C may be formed on a corresponding dielectric layer 122 such as dielectric layer 122-6, for example. Distance H2, H3, H4, and H0 may all be equal or two or more of distances H2, H3, H4, and H0 may be different. In the example of FIG. 9, distance H3 is equal to distance H4 and less than distance H2, whereas distance H2 is less than distance H0. Distances H0, H2, H3, and H4 may, for example, each be between 1 μm and 1 mm. As one example, distance H2 may be between 100 μm and 250 μm, distance H3 may be between 50 μm and 150 μm, distance H4 may be between 50 μm and 150 μm, and distance H0 may be between 100 μm and 250 μm. Optional solder mask layer 123 may, for example, have a thickness between 10 μm and 50 μm. Portions 104A, 104B, and 104C of multi-layer patch antenna resonating element 104 may sometimes each be referred to herein as patch antenna resonating element portions, antenna resonating element portions, resonating element portions, conductive traces, resonating element traces, conductive layers, antenna resonating element layers, or patches.

Antenna feed terminal 96 may be coupled to portion 104A of multi-layer patch antenna resonating element 104. Antenna resonating element portion 104A may have any desired lateral shape (e.g., in the X-Y plane of FIG. 9). For example, resonating element portion 104A may be a rectangular conductive patch, a square conductive patch, a circular conductive patch, an elliptical conductive patch, a polygonal conductive patch, a conductive patch having curved and/or straight sides, etc. Vertical conductor 124 of transmission line 64 may extend from transmission line conductor 126 through layer 122-2, opening 128 in ground layer 92, layer 122-3, and layer 122-4 to feed terminal 96 on patch antenna resonating element portion 104A. This example is merely illustrative and, if desired, other transmission line structures may be used.

An opening 140 is formed in patch antenna resonating element portion 104A (sometimes referred to herein as notch 140, gap 140, or slot 140). Opening 140 may, for example, be completely surrounded by the conductive material in antenna resonating element portion 104A on layer 122-4. Opening 140 may, for example, be formed by removing or etching material away from traces 104A or may be formed upon deposition of traces 104A on layer 122-4. Traces 104A may, for example, follow a continuous lateral conductive path that runs around opening 140 (e.g., in the X-Y plane of FIG. 9).

Antenna resonating element portion 104A may be shorted to second antenna resonating element 104B using a set of vertical conductive structures 136. For example, antenna resonating element portion 104A may be coupled to antenna resonating element portion 104B on layer 122-5 by a first vertical conductive structure 136-1 closest to feed terminal 96 and a second vertical conductive structure 136-2 coupled to an opposing side of antenna resonating element portion 104A. Vertical conductive structures 136 may, for example, include conductive through-vias extending through dielectric layer 122-5, conductive pins, solder bumps, metal pillars, combinations of these, or any other desired vertical conductive interconnect structures. Antenna feed terminal 96 may be laterally separated from vertical conductive structure 136-1 in layer 122-5 by distance D1. Vertical conductive structure 136-2 may be laterally separated from an outer edge of antenna resonating element portion 104A by distance D5. Vertical conductive structures 136 may each have a length equal to height H3, for example.

Antenna resonating element portion 104B may have any desired lateral shape (e.g., in the X-Y plane). For example, resonating element portion 104B may be a rectangular conductive patch, a square conductive patch, a circular conductive patch, an elliptical conductive patch, a polygonal conductive patch, a conductive patch having curved and/or straight sides, etc. An opening 142 may be formed in patch antenna resonating element portion 104B (sometimes referred to herein as notch 142, gap 142, or slot 142). Opening 142 may, for example, be completely surrounded by the conductive material in antenna resonating element portion 104B on layer 122-5. Opening 142 may, for example, be formed by removing or etching material away from traces 104B or may be formed upon deposition of traces 104B on layer 122-4. Traces 104B may, for example, follow a continuous conductive path that runs around opening 142 (in the X-Y plane).

Antenna resonating element portion 104B may be shorted to second antenna resonating element 104C using a set of vertical conductive structures 138. For example, antenna resonating element portion 104B may be coupled to antenna resonating element portion 104C on layer 122-6 by a first vertical conductive structure 138-1 located closest to vertical conductive structure 136-1 and a second vertical conductive structure 138-2 located closest to vertical conductive structure 136-2. Vertical conductive structures 138 may, for example, include conductive through-vias extending through dielectric layer 122-6, conductive pins, solder bumps, metal pillars, combinations of these, or any other desired vertical conductive interconnect structures. Vertical conductive structure 136-1 may be laterally separated from vertical conductive structure 138-1 by distance D2. Vertical conductive structure 138-2 may be laterally separated from vertical conductive structure 136-2 by distance D4. Vertical conductive structures 138 may each have a length equal to height H4, for example.

Antenna resonating element portion 104C may have any desired lateral shape. For example, resonating element portion 104C may be a rectangular conductive patch, a square conductive patch, a circular conductive patch, an elliptical conductive patch, a polygonal conductive patch, a conductive patch having curved and/or straight sides, etc. In the example of FIG. 9, resonating element portion 104C is a continuous conductor (e.g., without openings or slots within the conductor).

Vertical conductive structure 138-1 may be coupled to a first location on resonating element portion 104C. Vertical conductive structure 138-2 may be coupled to a second location on resonating element portion 104C that is laterally separated from the first location by distance D3. The electrical path length from antenna feed terminal 96 to the opposing side of resonating element portion 104A (e.g., through resonating element portions 104B and 104C and the corresponding vertical conductive structures) may be selected so that antenna 40 resonates at a desired operating frequency. The electrical path length may, for example, be approximately equal to the sum of distance D1, distance D2, distance D3, distance D4, distance D5, two times distance H3 (e.g., the length of both conductors 136-1 and 136-2), and two times distance H4 (e.g., the length of both conductors 138-1 and 138-2), this sum in turn being approximately equal to (e.g., within 15% of) the wavelength of operation of antenna 40 divided by twice the square root of dielectric constant $\varepsilon_R$ of substrate 120, for example. In the scenario where antenna 40 covers a millimeter wave communications band from 57 GHz to 71 GHz and dielectric constant $\varepsilon_R$ is approximately equal to 3.45, this path length may be between 1.0 mm and 1.2 mm, for example.

Patch antenna resonating element portion 104C and parasitic element 106 may define boundaries of a constrained volume 131. Constrained volume 131 may be less than the volume 130 associated with a single layer patch antenna resonating element (e.g., as shown in FIGS. 7 and 8) and parasitic element 106. Distributing patch antenna resonating element 104 across multiple layers (e.g., by forming resonating element portions 104A and 104B at greater distances than distance H0 with respect to parasitic element 106) may thereby serve to restrict the cavity resonance between parasitic element 106 and patch antenna resonating element 104 to constrained volume 131. Constraining the cavity resonance to volume 131 may shift the cavity resonance to higher frequencies that are farther away from the millimeter wave communications band of interest than the cavity resonance associated with volume 130. This may serve to minimize the amount of energy within the millimeter wave communications band of interest that is trapped between parasitic element 106 and patch antenna resonating element 104, thereby optimizing the overall antenna efficiency of antenna 40.

The example of FIG. 9 is merely illustrative. If desired, fewer or additional layers 122 may be interposed between trace 126 and ground 92, between ground 92 and resonating element portion 104A, between resonating element portion 104A and resonating element portion 104B, between resonating element portion 104B and resonating element portion 104C, and/or between resonating element portion 104C and parasitic element 106. In another suitable arrangement, substrate 120 may be formed from a single dielectric layer (e.g., antenna 40 may be embedded within a single dielectric layer such as a molded plastic layer). In yet another suitable arrangement, substrate 120 may be omitted and antenna 40 may be formed on other substrate structures or may be formed without substrates. If desired, resonating element portions 104A, 104B, and 104C, and/or parasitic element 106 may be formed from any other desired conductive structures within device 10. If desired, patch antenna resonating element 104 may be formed from only two different layers (e.g., conductive traces 104A and vertical conductors 136 may be omitted and feed terminal 96 may be coupled to conductive traces 104B) or from more than three different layers. In the example of FIG. 9, antenna 40 is shown as having only a single polarization (feed) for the sake of clarity. Antenna 40 may, if desired, be a dual-polarized patch antenna having two feeds.

Figure 10:
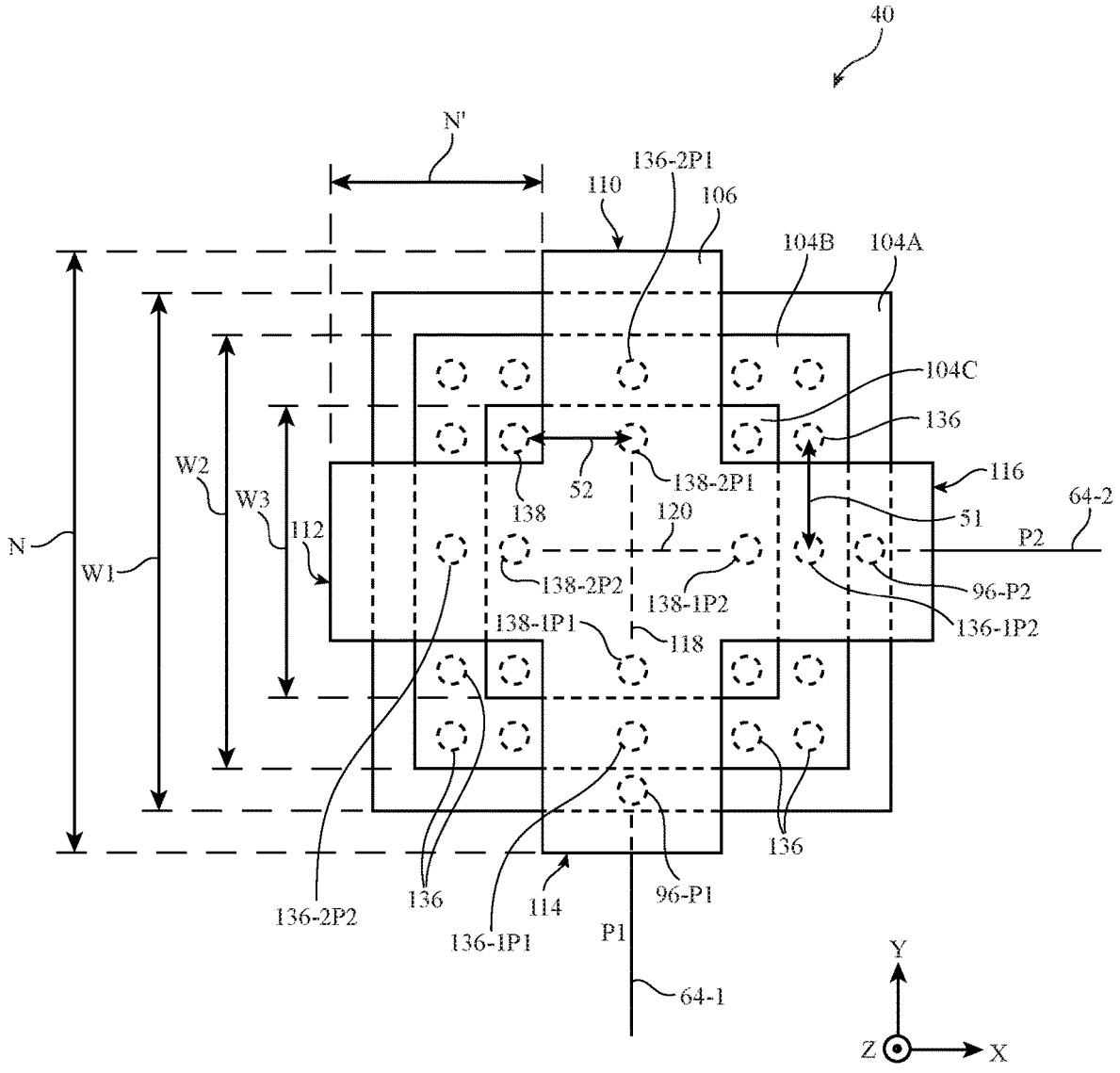
FIG. 10 is a top-down view of an illustrative patch antenna having a multi-layer antenna resonating element and a parasitic element in accordance with an embodiment.

FIG. 10 is a top-down view of an antenna of the type shown in FIG. 9 having a multi-layer patch antenna resonating element 104 and two feeds for covering two orthogonal polarizations. In the example of FIG. 10, dielectric substrate 120, dielectric layer 123, and ground 92 are not shown for the sake of clarity. As shown in FIG. 10, antenna feed terminals 96-P1 and 96-P2 may be coupled to patch antenna resonating element portion 104A along to two different orthogonal edges of patch antenna resonating element portion 104A.

Patch antenna resonating element portion 104B may be formed over patch antenna resonating element portion 104A. A set of vertical conductive structures 136 may be coupled between resonating element portions 104A and 104B. The set of vertical conductive structures 136 may include a vertical conductive structure 136-1P1 closest to feed terminal 96-1, a vertical conductive structure 136-1P2 closest to feed terminal 96-P2, a vertical conductive structure 136-2P1 opposite to vertical conductive structure 136-1P1, and a vertical conductive structure 136-2P2 opposite vertical conductive structure 136-1P2. Each vertical conductive structure 136 may be separated from two adjacent vertical conductive structures 136 by distance S1 (sometimes referred to herein as pitch S1). Distance S1 may be, for example, less than or equal to one-tenth of the wavelength of operation of antenna 40. When configured in this way, the set of structures 136 may appear to millimeter wave signals in the communications band of interest as a single continuous conductor, for example.

Patch antenna resonating element portion 104C may be formed over patch antenna resonating element portion 104B. A set of vertical conductive structures 138 may be coupled between resonating element portions 104B and 104C. The set of vertical conductive structures 138 may include a vertical conductive structure 138-1P1 closest to vertical conductive structure 136-1P1, a vertical conductive structure 138-1P2 closest to vertical conductive structure 136-1P2, a vertical conductive structure 138-2P1 opposite vertical conductive structure 138-1P1, and a vertical conductive structure 138-2P2 opposite vertical conductive structure 138-1P2. Each vertical conductive structure 138 may be separated from two adjacent vertical conductive structures 138 by distance S2 (sometimes referred to herein as pitch S2). Distance S2 may be equal to, less than, or greater than distance S1. Distance S2 may be, for example, less than or equal to one-tenth of the wavelength of operation of antenna 40. When configured in this way, the set of structures 138 may appear to millimeter wave signals in the communications band of interest as a single continuous conductor, for example.

Parasitic antenna resonating element 106 (e.g., as described above in connection with FIGS. 7 and 8) may be formed over patch antenna resonating element portion 104C. Parasitic antenna resonating element arms 114 and 110 extending along longitudinal axis 118 may be formed over (e.g., may overlap) feed terminal 96-P1 and conductive structures 136-1P1, 138-1P1, 136-2P1, and 138-2P1. Parasitic antenna resonating element arms 112 and 116 extending along longitudinal axis 120 may be formed over feed terminal 96-P2 and conductive structures 136-2P2, 138-2P2, 138-1P2, and 136-1P2. Parasitic element 106 may serve to broaden the bandwidth of antenna 40 while also ensuring that patch antenna resonating element portions 104A, 104B, and 104C are impedance matched to both transmission lines 64-1 and 64-2, for example.

As shown in FIG. 10, patch antenna resonating element portion 104A may have a width W1, patch antenna resonating element portion 104B may have a width W2, and patch antenna resonating element portion 104C may have a width W3. Width W3 may be less than width W2 and width W2 may be less than width W1. Width W1 may be less than, greater than, or equal to width N of parasitic antenna resonating element 106. Because the resonating frequency of antenna 40 is determined by the electrical path length between feed terminal 96-P1 and the edge of patch 104A adjacent to structure 136-2P1 (e.g., over a first portion of patch 104A, structure 136-2P1, a first portion of patch 104B, structure 138-2P1, patch 104C, structure 138-1P1, a second portion of patch 104B, structure 136-1P1, and a second portion of patch 104A between structure 136-1P1 and terminal 96-P1) and/or by the electrical length between feed terminal 96-P2 and the edge of patch 104A adjacent to structure 136-2P2 (e.g., over a third portion of patch 104A, structure 136-2P2, a third portion of patch 104B, structure 138-2P2, patch 104C, structure 138-1P2, a fourth portion of patch 104B, structure 136-1P2, and a fourth portion of patch 104A between structure 136-1P2 and terminal 96-P2), width W1 may be less than width M of the single-layer patch antenna shown in FIG. 8. As an example, width W1 may be between 0.9 mm and 1.1 mm, width W2 may be between 0.8 mm and 0.9 mm, and width W3 may be between 0.4 mm and 0.8 mm.

Opening 140 in resonating element portion 104A and opening 142 in resonating element portion 104B (FIG. 9) are not shown in FIG. 10 for the sake of clarity. However, in a suitable arrangement, openings 140 and 142 may be square-shaped openings. In other scenarios, openings 140 and 142 may, in theory, have rectangular, circular, elliptical, polygonal, may have a shape with curved and/or straight edges, may have a cross shape similar to parasitic element 106, etc. Opening 140 may have width (e.g., a maximum lateral dimension, a length of a side of the opening, a length of a longest side of the opening, a length of a side of a rectangular footprint of the opening, etc.) that is between 10% and 80% of width W1 of resonating element portion 104A. Opening 142 may have width (e.g., a maximum lateral dimension, a length of a side of the opening, a length of a longest side of the opening, a length of a side of a rectangular footprint of the opening, etc.) that is between 10% and 80% of width W2 of resonating element portion 104B. The example of FIG. 10 in which patch antenna resonating element portions 104A, 104B, and 104C each have square shapes with aligned edges is merely illustrative. If desired, patch antenna resonating element portions 104A, 104B, and/or 104C may be formed using conductive structures having any desired shapes, orientations, and corresponding polarizations.

In general, any desired number of conductive structures 136 may be formed between patch antenna resonating element portions 104A and 104B (e.g., four structures 136 such as structures 136-1P1, 136-2P1, 136-1P2, and 136-2P2, between four and thirty-two structures 136, sixteen structures 136, etc.). Any desired number of conductive structures 138 may be formed between patch antenna resonating element portions 104B and 104C (e.g., four structures 138 such as structures 138-1P1, 138-2P1, 138-1P2, and 138-2P2, between four and thirty-two structures 138, eight structures 138, etc.). In another suitable arrangement, structures 136 may be formed from one or more continuous conductive walls extending between resonating element portions 104A and 104B and/or structures 138 may be formed from one or more continuous conductive walls extending between resonating element portions 104B and 104C (e.g., around all sides of openings 140 and 142, respectively).

Figure 11:
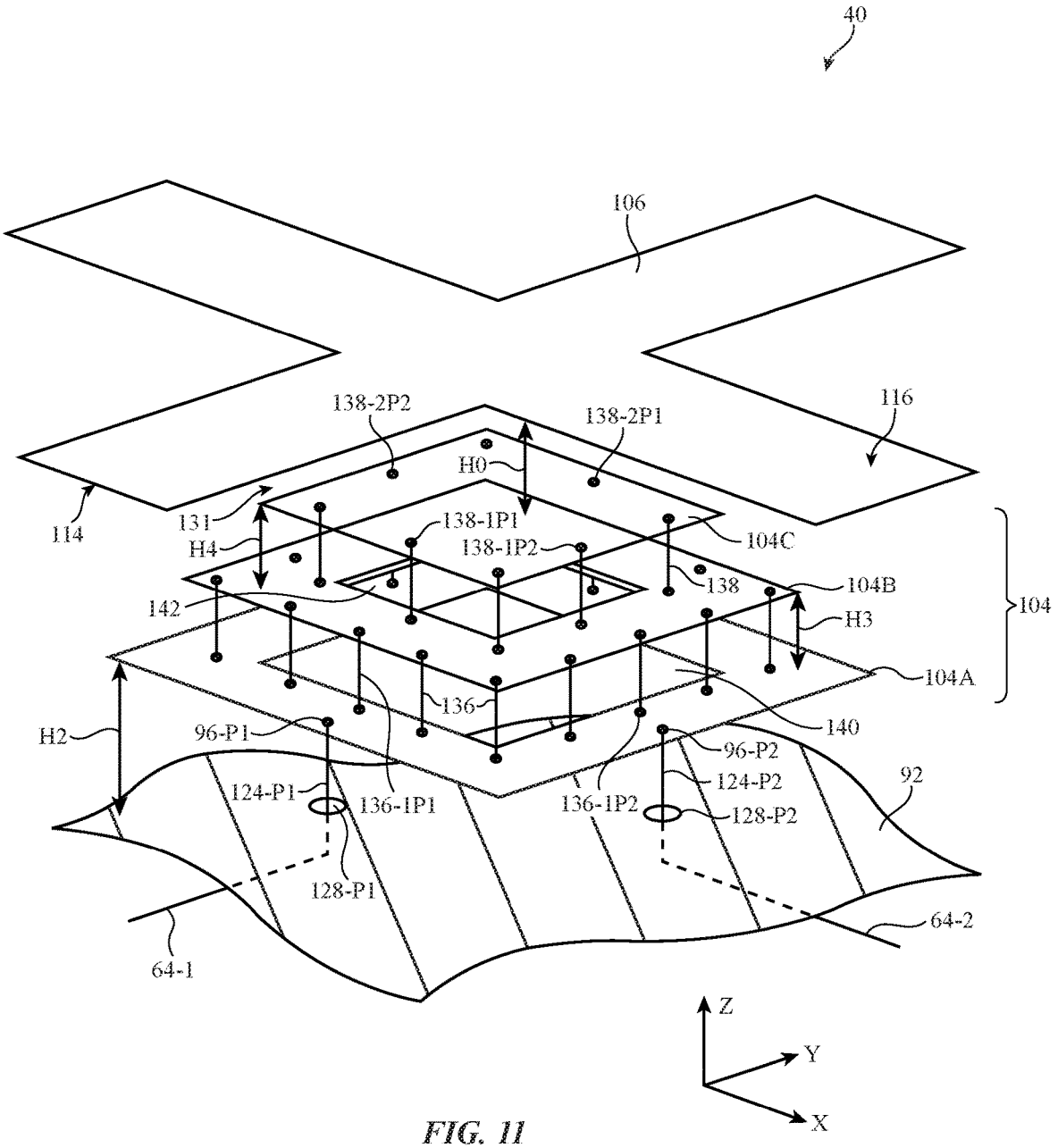
FIG. 11 is a perspective view of an illustrative patch antenna having a multi-layer antenna resonating element and a parasitic element in accordance with an embodiment.

FIG. 11 is a perspective view of an antenna of the type shown in FIGS. 9 and 10 having a multi-layer patch antenna resonating element 104 and two feeds for covering two orthogonal polarizations. In the example of FIG. 11, dielectric substrate 120 and dielectric layer 123 are not shown for the sake of clarity.

As shown in FIG. 11, first portion 104A of patch antenna resonating element 104 may be formed at distance H2 above ground plane 92. Second portion 104B of patch antenna resonating element 104 may be formed at distance H3 above portion 104A. Third portion 104C of patch antenna resonating element 104 may be formed at distance H4 above portion 104B. Cross-shaped parasitic antenna resonating element 106 may be formed at distance H0 above portion 104C of patch antenna resonating element 104. A set or fence of vertical conductive structures 136 may couple portion 104A to portion 104B. A set or fence of vertical conductive structures 138 may couple portion 104B to portion 104C. Conductive structures 136 may collectively appear as a single continuous conductor and/or conductive structures 138 may collectively appear as a single continuous conductor to millimeter wave signals, for example.

Opening 140 may be surrounded by the conductive material in resonating element portion 104A (e.g., portion 104A may follow a loop or ring shaped conductive path around opening 140). Opening 142 may be surrounded by the conductive material in resonating element portion 104B (e.g., portion 104B may follow a loop or ring shaped conductive path around opening 142). Resonating element portions 104B and 104C may cover an entirety of opening 140. Resonating element portion 104C may cover an entirety of opening 142. The example of FIG. 11 is merely illustrative and, if desired, other arrangements may be used.

A first hole 128-P1 and a second hole 128-P2 may be formed in ground plane 92. Transmission line 64-1 (e.g., the corresponding vertical conductor 124-P1) may extend through hole 128-P1 to feed terminal 96-P1 on resonating element portion 104A. Transmission line 64-2 (e.g., the corresponding vertical conductor 124-P2) may extend through hole 128-P2 in ground plane 92 to feed terminal 96-P2 on resonating element portion 104A. If desired, vertical conductors 124-P1 and 124-P2 may both pass through the same hole 128 in ground plane 92. Feed terminals 96-P1 and 96-P2 may be overlapped by (e.g., located directly beneath or within the lateral outline of) arms 114 and 116 of cross-shaped parasitic element 106, respectively.

Antenna resonating element portion 104C and parasitic antenna resonating element 106 may define constrained volume 131. Antenna resonating element portion 104A and parasitic antenna resonating element 106 may define a volume that is greater than volume 131. The reduced size of constrained volume 131 may cause antenna 40 to trap millimeter wave energy within volume 131 at higher frequencies (e.g., frequencies above the millimeter wave communications band of interest) than in scenarios where a single layer antenna resonating element is used.

Forming patch antenna resonating element 104 from multiple conductive layers may consume more vertical space (e.g., along the Z-axis of FIGS. 9-11) than in scenarios where antenna resonating element 104 is confined to a single plane. As space is often at a premium in devices such as device 10, antenna resonating element 104 may, if desired, be formed from a single conductive layer that is confined to a single plane. Dielectric-filled openings may be formed in antenna resonating element 104 in these scenarios to mitigate the trapping of millimeter wave signals between antenna resonating element 104 and parasitic element 106.

Figure 12:
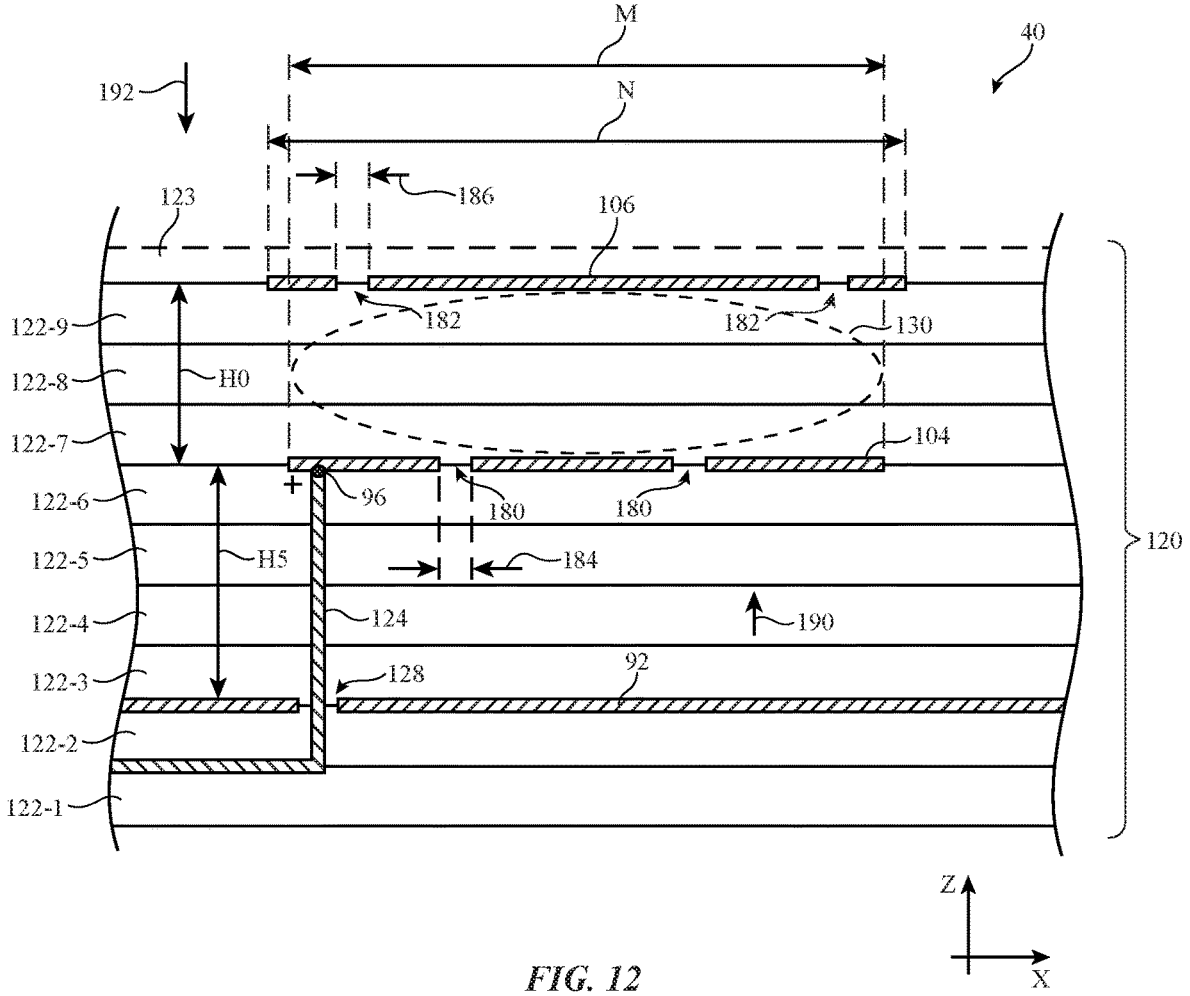
FIG. 12 is a cross-sectional side view of an illustrative patch antenna having a single layer antenna resonating element and a parasitic element with dielectric-filled openings in accordance with an embodiment.

FIG. 12 is cross-sectional side view showing how antenna resonating element 104 may be formed from a single conductive layer including dielectric-filled openings for mitigating the trapping of millimeter wave signals. As shown in FIG. 12, patch antenna resonating element 104 may be formed at a distance H5 with respect to ground plane 92. Distance H5 may be the same as distance H1 of FIG. 7, may be less than distance H1, or may be greater than distance H1. As one example, distance H5 may be between 50 μm and 500 μm. Patch antenna resonating element 104 may be formed from a single layer of conductive traces on a single dielectric layer 122 of substrate 120 such as dielectric layer 122-6. Parasitic antenna resonating element 106 may be formed at distance H0 above patch antenna resonating element 104 (e.g., on layer 122-9).

Patch antenna resonating element 104 may have a width M (e.g., as described above in connection with FIG. 7). Parasitic element 106 may configure antenna 40 to cover a relatively wide millimeter wave communications band of interest such as a frequency band between 57 GHz and 71 GHz. Volume 130 may be defined between parasitic element 106 and the single-layer patch antenna resonating element 104. As described above in connection with FIG. 7, if care is not taken, volume 130 may be associated with a cavity resonance that serves to trap millimeter wave signals (energy) within volume 130 at frequencies around the upper threshold frequency of the millimeter wave communications band of interest. For example, elements 106 and 104 may serve as a parallel plate resonator and may define boundary conditions for the cavity resonance between elements 106 and 104 (e.g., nodes or boundaries for standing waves of EHF energy trapped between elements 106 and 104).

If desired, patch antenna resonating element 104 may include one or more dielectric-filled openings such as openings 180 and/or parasitic resonating element 106 may include one or more dielectric-filled openings such as openings 182. Openings 180 and/or 182 may disrupt the cavity resonance between parasitic element 106 and patch antenna resonating element 104 (e.g., by disrupting the boundary conditions of volume 130 and corresponding standing waves of EHF energy between elements 106 and 104). Such disruption of the cavity resonance may serve to mitigate the trapping of corresponding millimeter wave signals within volume 130 (e.g., so that the millimeter wave signals are radiated outwards and towards external communications equipment rather than remaining trapped within volume 130).

Openings 180 (sometimes referred to herein as notches 180, slots 180, or gaps 180) may each have a width 184. Openings 182 (sometimes referred to herein as notches 182, slots 182, or gaps 182) may each have a width 186. Openings 180 may be formed in resonating element 104 by etching (e.g., laser etching), stripping, cutting, or otherwise removing conductive material in resonating element 104 from the surface of dielectric layer 122-6, or may be formed upon deposition of patch antenna resonating element 104 onto the surface of dielectric layer 122-6. Openings 180 may extend through the entire thickness of antenna resonating element 104, thereby exposing dielectric layer 122-6 through antenna resonating element 104. Openings 182 may be formed in parasitic element 106 by etching (e.g., laser etching), stripping, cutting, or otherwise removing conductive material in parasitic element 106 from the surface of dielectric layer 122-9, or may be formed upon deposition of parasitic element 106 onto the surface of dielectric layer 122-9. Openings 182 may extend through the entire thickness of parasitic element 106, thereby exposing dielectric layer 122-9 through parasitic element 106.

Width 184 of gaps 180 may be selected to disrupt the cavity resonance in volume 130 while still allowing antenna currents from antenna feed terminal 96 to flow across patch antenna resonating element 104. For example, gaps 180 may introduce an increased transverse impedance (e.g., in the direction of the Z-axis) that serves to disrupt standing waves in the transverse direction between elements 104 and 106, while also exhibiting a relatively low lateral impedance across the surface of layer 104 (e.g., in the X-Y plane) so that antenna currents may still flow freely across layer 104. As an example, width 184 may be between 0.1% and 10% of width M, between 10 μm and 100 μm, between 20 μm and 200 μm, between 20 μm and 40 μm (e.g., approximately equal to 30 μm), between 1 μm and 10 μm, or less than 1 μm. Width 186 of gaps 182 may be selected to adjust the impedance of patch antenna resonating element 104 (e.g., to ensure that antenna 40 is suitably matched to one or more transmission lines 64). As an example, width 186 may be between 10 μm and 100 μm, between 20 μm and 200 μm, between 1 μm and 10 μm, or less than 1 μm.

The example of FIG. 12 is merely illustrative. If desired, fewer or additional layers 122 may be interposed between trace 126 and ground 92, between ground 92 and resonating element 104, and/or between resonating element 104 and parasitic element 106. In another suitable arrangement, substrate 120 may be formed from a single dielectric layer (e.g., antenna 40 may be embedded within a single dielectric layer such as a molded plastic layer). In yet another suitable arrangement, substrate 120 may be omitted and antenna 40 may be formed on other substrate structures or may be formed without substrates.

Figure 13:
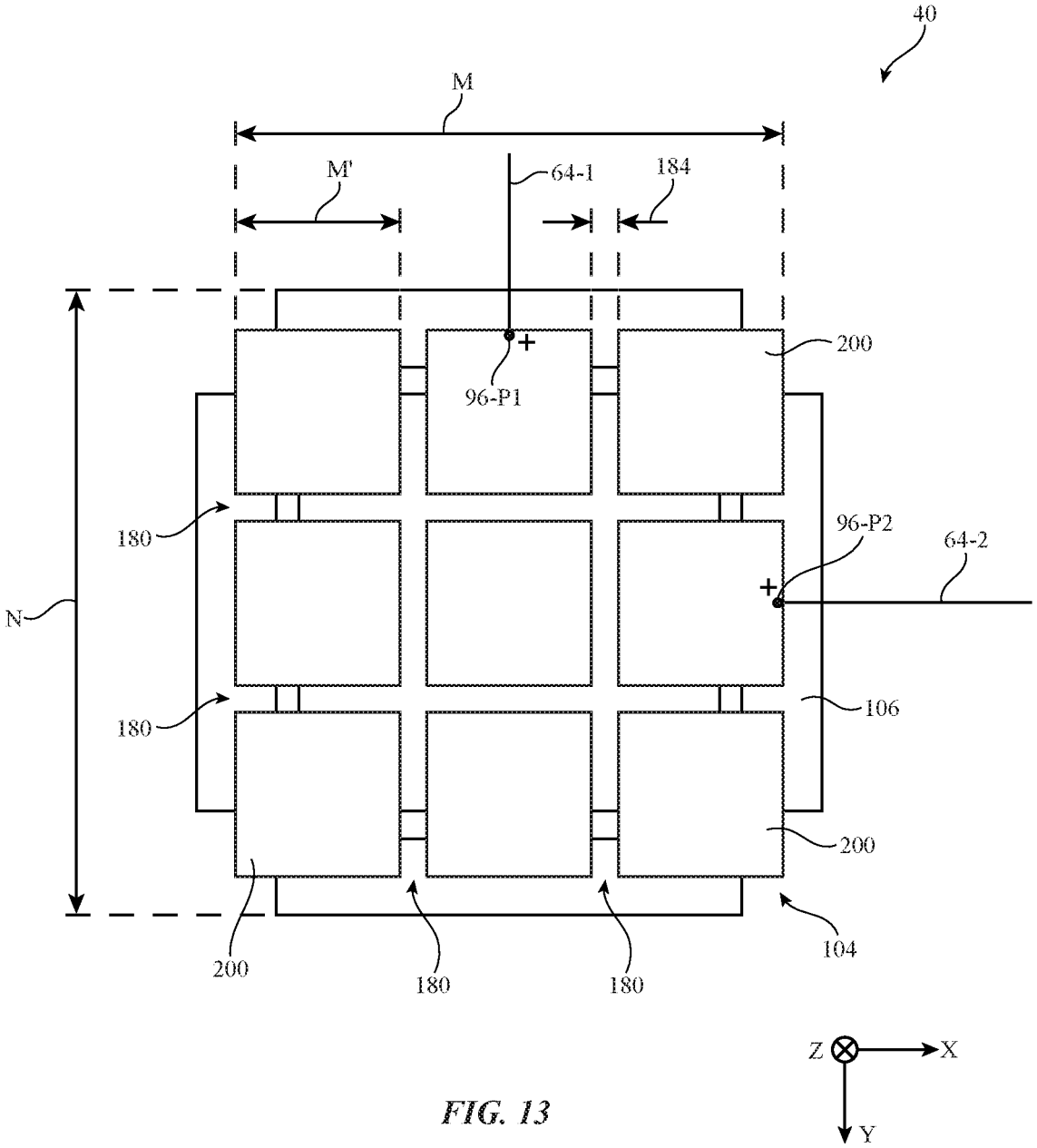
FIG. 13 is a bottom-up view of an illustrative patch antenna having a single layer antenna resonating element and a parasitic element with dielectric-filled openings in accordance with an embodiment.

In the example of FIG. 12, antenna 40 is shown as having only a single polarization (feed) for the sake of clarity. Antenna 40 may, if desired, be a dual-polarized patch antenna having two feeds. FIG. 13 is a bottom-up view of an antenna of the type shown in FIG. 12 (e.g., as taken in direction 190 of FIG. 12) having two feeds and a single layer patch antenna resonating element with slots for mitigating the trapping of millimeter wave signals within volume 130. In the example of FIG. 13, dielectric substrate 120, layer 123, and ground 92 are not shown for the sake of clarity.

As shown in FIG. 13, a grid of openings 180 may be formed in patch antenna resonating element 104. If desired, openings 180 may be filled with a dielectric material such as plastic, glass, ceramic, epoxy, adhesive, integral portions of dielectric layer 122-6, integral portions of dielectric layer 122-7, or other dielectric materials. If desired, openings 180 may be filled with air. In yet another suitable arrangement, openings 180 may extend only partially through the thickness of patch antenna resonating element 104 (e.g., some of the conductive material in traces 104 may remain within openings 180 if desired).

In the example of FIG. 13, openings 180 are formed within antenna resonating element 104 in a rectangular grid pattern in which openings 180 divide antenna resonating element 104 into two or more rectangular conductive segments 200 (e.g., the edges of conductive segments 200 may be defined by openings 180). If desired, conductive segments 200 may be arranged in an array having one or more rows and one or more columns (e.g., aligned rows and columns). In another suitable arrangement, the rows and/or columns of segments 200 in the array may be misaligned (e.g., the even numbered rows or columns of segments 200 may all be aligned with each other whereas the odd numbered rows or columns of segments 200 are all aligned with each other but misaligned with respect to the even numbered rows and columns). Segments 200 may be arranged in any other desired pattern if desired. Each of the rectangular segments 200 in antenna resonating element 104 may be separated from other rectangular segments 200 by a corresponding one of openings 180. Conductive segments 200 may sometimes be referred to herein as conductive tiles, patches, or portions of resonating element 104.

Each rectangular segment 200 may have the same size and dimensions or two or more segments 200 may have different sizes or dimensions. In the example of FIG. 13, each rectangular segment has a width M'. As examples, width M' may be between 0.1% and 50% of width M of resonating element 104 (e.g., between 0.1 mm and 0.6 mm, between 0.3 mm and 0.4 mm, between 0.2 mm and 0.5 mm, etc.). Resonating element 104 may include any desired number of segments 200 (e.g., between two and four segments, four or more segments, between four and nine segments, between nine and sixteen segments, more than sixteen segments, etc.).

Antenna feed terminal 96-P1 and the corresponding transmission line 64-1 may be coupled to a first segment 200 at a first side of resonating element 104. Antenna feed terminal 96-P2 and the corresponding transmission line 64-2 may be coupled to a second segment 200 at a second orthogonal side of resonating element 104. Width 184 of openings 180 may be sufficiently small so as to allow antenna currents conveyed by feed terminals 96-P1 and 96-P1 to freely flow across the lateral area of antenna resonating element 104 (e.g., openings 180 may be narrow enough so as to appear as a short circuit in the X-Y plane at millimeter wave frequencies so that the antenna currents freely pass across multiple segments 200). At the same time, openings 180 may sufficiently disrupt the millimeter wave impedance of antenna 40 in the transverse direction (e.g., along the Z-axis) so as to disrupt the cavity resonance associated with volume 130.

The example of FIG. 13 in which a grid of openings 180 divide antenna resonating element 104 into an array of rectangular segments 200 is merely illustrative. If desired, openings 180 may divide antenna resonating element 104 into conductive segments of any desired shape (e.g., hexagonal segments, circular segments, elliptical segments, triangular segments, segments having curved and/or straight edges, etc.). Openings 180 may follow straight and/or curved paths in resonating element 104. Each opening 180 may have the same width 184 or two or more openings 180 may have different widths. Openings 180 may extend parallel to at least one edge of antenna resonating element 104 or may extend at non-parallel angles with respect to all of the edges of antenna resonating element 104. Width M' of segments 200 may be equal to the length of a side of segments 200, to a diameter of segments 200 (e.g., in scenarios where segments 200 are circular), equal to a major axis length of segments 200 (e.g., in scenarios where segments 200 are elliptical), may be equal to a maximum lateral dimension of the segment, a length of a side of the segment such as the longest side of the segment, a length of a side of a rectangular footprint of the segment, etc. Antenna resonating element 104 may have any desired shape or dimensions (e.g., with curved and/or straight edges). Any desired number of openings 180 may be formed in antenna resonating element 104 (e.g., one opening 180, two openings 180, more than two openings 180, etc.). Openings 180 in antenna resonating element 104 need not be connected to each other.

Figure 14:
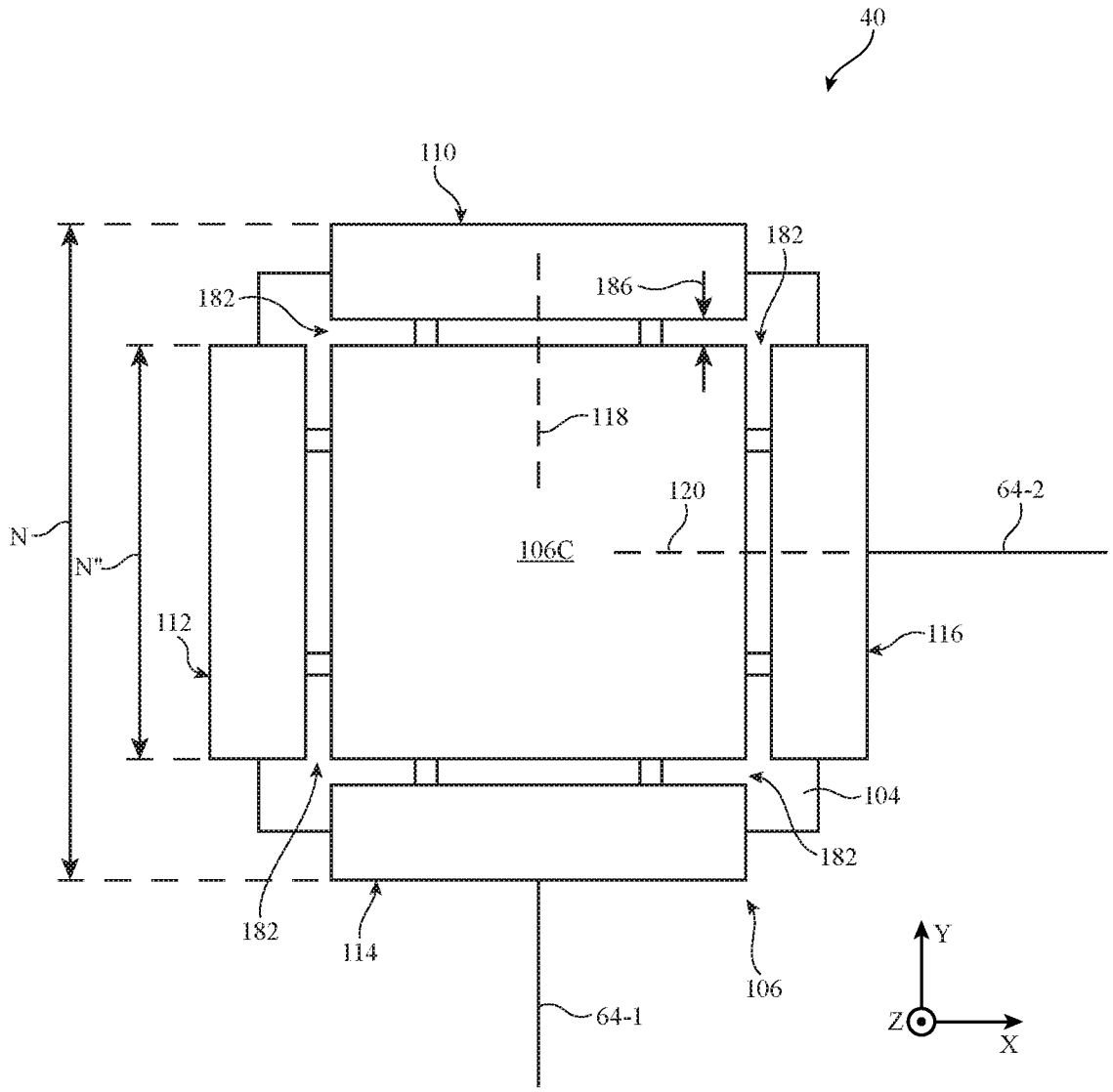
FIG. 14 is a top-down view of an illustrative patch antenna having a single layer antenna resonating element and a parasitic element with dielectric-filled openings in accordance with an embodiment.

FIG. 14 is a top-down view of an antenna of the type shown in FIGS. 12 and 13 (e.g., as taken in direction 192 of FIG. 12). In the example of FIG. 14, dielectric substrate 120, layer 123, and ground 92 are not shown for the sake of clarity. As shown in FIG. 14, openings 182 may be formed in parasitic element 106. Openings 182 may, for example, separate arms 110, 112, 114, and 116 from a central portion 106C of parasitic element 106. If desired, openings 182 may be filled with a dielectric material such as plastic, glass, ceramic, epoxy, adhesive, integral portions of dielectric layer 122-9, integral portions of dielectric layer 123 (FIG. 12), or other dielectric materials. If desired, openings 182 may be filled with air. In yet another suitable arrangement, openings 182 may extend only partially through the thickness of parasitic element 106 (e.g., some of the conductive material in traces 106 may remain within openings 182 if desired).

In the example of FIG. 14, openings 182 each have a length that is equal to the width N" of central portion 106C and arms 110, 112, 114, and 116. Width N" may, for example, be equal to between 20% and 80% of the width N of the rectangular footprint of parasitic element 106. As examples, width N" may be between 0.7 mm and 0.8 mm, between 0.6 mm and 0.9 mm, between 0.5 mm and 0.8 mm, less than 0.5 mm, etc. Openings 182 may each have a width 186 that is equal to, greater than, or less than width 184 of openings 180 in antenna resonating element 104. Openings 180 in antenna resonating element 104 may alter the impedance of antenna resonating element 104. Openings 182 in parasitic element 106 may serve to compensate for the change in impedance of resonating element 104 generated by the presence of openings 180 (e.g., so that resonating element 104 may be impedance matched to both transmission lines 64-1 and 64-2).

The example of FIG. 14 is merely illustrative. If desired, openings 182 may be arranged in a grid similar to openings 180 in resonating element 104. Additional openings may be formed within central portion 106C if desired. Openings 182 may follow straight paths and/or curved paths. Openings 182 may extend parallel to at least one edge of parasitic element 106 or may extend at non-parallel angles with respect to all of the edges of parasitic element 106. Openings 182 may extend only part way across the width N" of arms 110, 112, 114, and 116 if desired. Any desired number of openings 182 may be formed in antenna resonating element 104 (e.g., one opening 182, two openings 182, more than two openings 182, etc.). In another suitable arrangement, openings 182 may be omitted. In general, parasitic element 106 may have any desired shape, relative orientation with respect to the sides of antenna resonating element 104, number of arms and longitudinal axes, curved and/or straight edges, etc.

Figure 15:
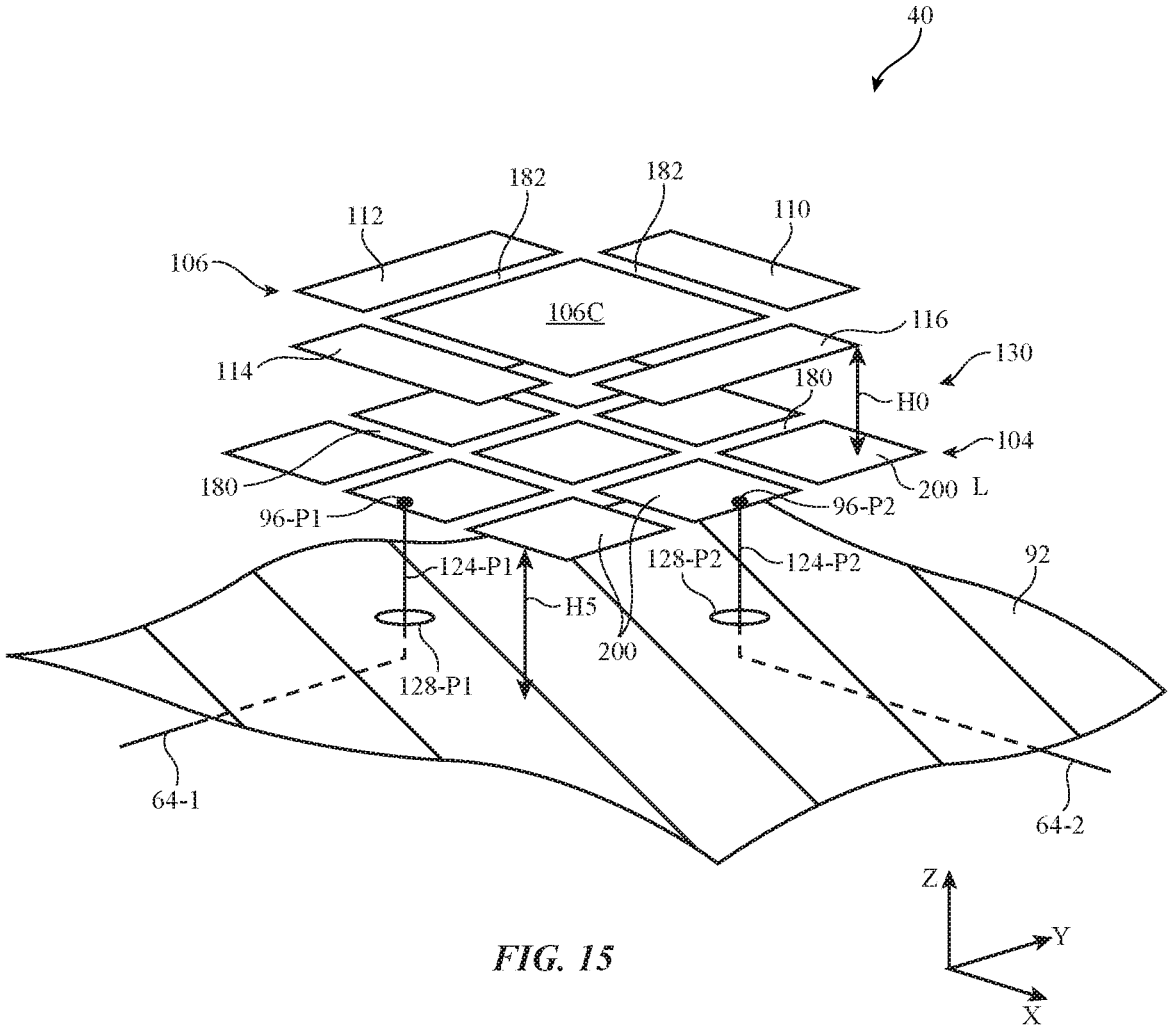
FIG. 15 is perspective view of an illustrative patch antenna having a single layer antenna resonating element and a parasitic element with dielectric-filled openings in accordance with an embodiment.

FIG. 15 is a perspective view of an antenna of the type shown in FIGS. 12-14. In the example of FIG. 15, dielectric substrate 120 and layer 123 are not shown for the sake of clarity. As shown in FIG. 15, patch antenna resonating element 104 may be formed at distance H2 above ground plane 92. Cross-shaped parasitic antenna resonating element 106 may be formed at distance H0 above patch antenna resonating element 104. Arm 114 of parasitic element 106 may overlap first feed terminal 96-1 whereas arm 116 of parasitic element 106 overlaps second feed terminal 96-2.

A first hole 128-P1 and a second hole 128-P2 may be formed in ground plane 92. Transmission line 64-1 (e.g., the corresponding vertical conductor 124-P1) may extend through hole 128-P1 to feed terminal 96-P1 on a first segment 200 of resonating element 104. Transmission line 64-2 (e.g., the corresponding vertical conductor 124-P2) may extend through hole 128-P2 in ground plane 92 to feed terminal 96-P2 on a second segment 200 of resonating element 104. If desired, vertical conductors 124-P1 and 124-P2 may pass through the same opening 128 in ground plane 92.

Volume 130 may be defined between parasitic element 106 and patch antenna resonating element 104. Openings 180 may be formed within patch antenna resonating element 104 for disrupting the cavity resonance associated with volume 130 (e.g., to the mitigate trapping of millimeter wave signals within volume 130). Openings 182 may be formed within cross-shaped parasitic element 106 (e.g., between arms 110, 112, 114, and 116 and central portion 106C) to compensate for adjustments in impedance introduced by openings 180 (e.g., to ensure that resonating element 104 is suitably matched to transmission lines 64-1 and 64-2). By disrupting the cavity resonance associated with volume 130, millimeter wave signals that would otherwise be trapped within volume 130 may be radiated away from antenna 40. Because antenna resonating element 104 is formed from a single layer of conductive material in the example of FIG. 15, the vertical distance required to implement antenna 40 in this example may be less than required in scenarios where resonating element 104 is formed using multiple conductive layers (e.g., as shown in FIGS. 9-11). However, forming antenna resonating element 104 using multiple conductive layers may, for example, increase the isolation between feed terminals 96-P1 and 96-P2 relative to scenarios where resonating element 104 includes only a single conductive layer (e.g., as shown in FIGS. 12-15).

Figure 16:
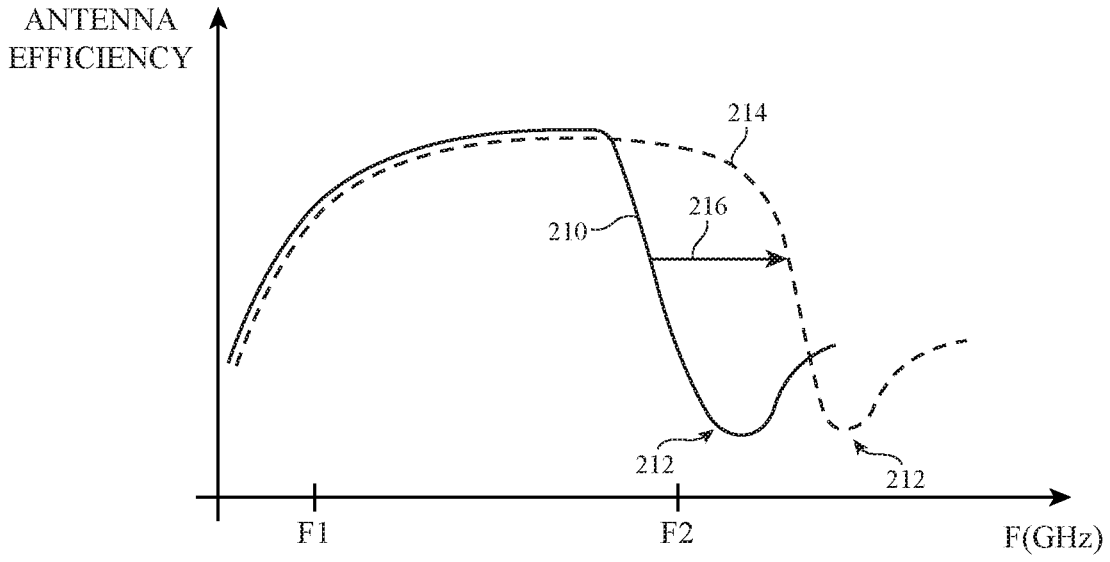
FIG. 16 is a graph of antenna efficiency for illustrative patch antennas of the types shown in FIGS. 7-15 in accordance with an embodiment.

FIG. 16 is a graph of antenna performance (antenna efficiency) as a function of frequency for an illustrative antenna of the types shown in FIGS. 9-15. As shown in FIG. 16, curve 210 illustrates the efficiency of antenna 40 of the type shown in FIGS. 7 and 8. Curve 210 exhibits a peak antenna efficiency within a millimeter wave communications band of interest defined by lower threshold frequency F1 (e.g., 57 GHz) and upper threshold frequency F2 (e.g., 71 GHz). Curve 210 may exhibit a minimum 212 generated as a result of the trapping of millimeter wave energy at relatively high frequencies such as frequencies around upper threshold F2 within volume 130. Minimum 212 of curve 210 may, for example, be at a frequency of 72 GHz. Minimum 212 may cause the efficiency of antenna 40 to be reduced around upper threshold frequency F2, thereby introducing the potential for data errors when antenna 40 is operated near upper threshold frequency F2.

Curve 214 illustrates the efficiency of antenna 40 when formed using a single layer patch antenna resonating element with cavity resonance mitigating openings 180 (e.g., as shown in FIGS. 12-15) or when formed using a multi-layer patch antenna resonating element (e.g., as shown in FIGS. 9-11). Curve 214 exhibits a peak antenna efficiency within the millimeter wave communications band of interest between frequencies F1 and F2. However, minimum 212 of curve 214 is shifted to a higher frequency as shown by arrow 216. As an example, minimum 212 of curve 214 may be shifted to a frequency of 76 GHz. This shift may allow antenna 40 to exhibit satisfactory efficiency around upper threshold frequency F2, thereby minimizing the risk for data errors when antenna 40 is operated near upper threshold frequency F2. Frequency shift 216 may be generated, for example, by constraining the volume between patch antenna resonating element 104 and parasitic element 106 (e.g., as shown by volume 131 of FIGS. 9-11). Disrupting the cavity resonance associated with volume 130 using resonance mitigating openings 180 (e.g., as shown in FIGS. 12-15) may also serve to generate an antenna efficiency curve such as curve 214 that covers the entirety of the millimeter wave frequency band between thresholds F1 and F2.

The example of FIG. 16 is merely illustrative. In general, the efficiency curve associated with antenna 40 may have any desired shape. Antenna 40 may exhibit peaks in efficiency at more than one frequency (e.g., in scenarios where antenna 40 is a multi-band antenna). The millimeter wave communications band of interest may be defined by any desired millimeter wave threshold frequencies (e.g., frequencies F1 and F2 may be any desired frequencies between 10 GHz and 400 GHz, where F2 is higher than F1). As other examples, the communications band of interest may be between 27.5 GHz and 28.5 GHz, may be between 37 GHz and 41 GHz, may be between 27.5 GHz and 41 GHz, may be between 41 GHz and 71 GHz, may be between 57 GHz and 64 GHz, etc. If desired, cavity resonance mitigating openings such as openings 180 of FIGS. 12-15 may be formed within resonating element portions 104A, 104B, and/or 104C of FIGS. 9-11. Openings 182 may be formed in parasitic 106 regardless of the number of layers used to form resonating element 104.

The foregoing is merely illustrative and various modifications can be made by those skilled in the art without departing from the scope and spirit of the described embodiments. The foregoing embodiments may be implemented individually or in any combination.

What is claimed is:

1. An antenna configured to radiate at a frequency between 10 GHz and 300 GHz, the antenna comprising:

an antenna ground;

a stacked dielectric substrate having first and second layers, the first layer being interposed between the antenna ground and the second layer;

an antenna resonating element comprising first conductive traces on the first layer, wherein a grid of openings is formed in the first conductive traces;

a parasitic element comprising second conductive traces on the second layer, wherein the grid of openings comprises first and second intersecting openings configured to disrupt a cavity resonance between the parasitic element and the antenna resonating element; and an antenna feed having a first feed terminal coupled to the first conductive traces and a second feed terminal coupled to the antenna ground.

2. The antenna defined in claim 1, wherein the grid of openings divides the first conductive traces into at least first and second conductive patches and the first feed terminal is coupled to the first conductive patch, further comprising:

an additional antenna feed having a third feed terminal coupled to the second conductive patch and a fourth feed terminal coupled to the antenna ground.

3. The antenna defined in claim 2, wherein a set of gaps in the second conductive traces divide the second conductive traces into at least third and fourth conductive patches, the third conductive patch overlaps the first feed terminal, and the fourth conductive patch overlaps the third feed terminal.

4. The antenna defined in claim 2, wherein the first conductive traces have a first width and each of the openings in the grid of openings has a second width, the second width being between 0.1% and 10% of the first width.

5. The antenna defined in claim 4, wherein the second width is between 10 microns and 100 microns.

6. The antenna defined in claim 1, wherein third, fourth, fifth, and sixth openings are formed in the second conductive traces.

7. The antenna defined in claim 6, wherein the third, fourth, fifth, and sixth openings divide the parasitic element into first, second, third, fourth, and fifth patches.

8. The antenna defined in claim 7, wherein the first patch is interposed between the second and third patches, the first patch is interposed between the fourth and fifth patches, and the fifth patch overlaps the first feed terminal coupled to the first conductive traces.

9. The antenna defined in claim 7, wherein the first patch is a square patch and the second, third, fourth, and fifth patches are rectangular patches.

10. An antenna configured to radiate at a frequency between 10 GHz and 300 GHz, the antenna comprising:

an antenna ground;

a stacked dielectric substrate having first and second layers, the first layer being interposed between the antenna ground and the second layer;

an antenna resonating element comprising first conductive traces on the first layer, wherein a grid of openings is formed in the first conductive traces and the grid of openings comprises first and second parallel openings;

a parasitic element comprising second conductive traces on the second layer; and an antenna feed having a first feed terminal coupled to the first conductive traces and a second feed terminal coupled to the antenna ground, wherein the first and second parallel openings are configured to disrupt a cavity resonance between the parasitic element and the antenna resonating element.

11. The antenna defined in claim 10, wherein the grid of openings comprises third and fourth parallel openings, the third and fourth parallel openings being oriented at a non-parallel angle with respect to the first and second parallel openings.

12. The antenna defined in claim 10, wherein third and fourth parallel openings are formed in the second conductive traces.

13. The antenna defined in claim 12, wherein fifth and sixth parallel openings are formed in the second conductive traces, the fifth and sixth parallel openings being oriented at a non-parallel angle with respect to the third and fourth parallel openings.

14. An antenna configured to radiate at a frequency between 10 GHz and 300 GHz, the antenna comprising:

an antenna ground;

an antenna resonating element overlapping the antenna ground, wherein the antenna resonating element comprises a first opening and a second opening that intersects the first opening;

a parasitic element overlapping the antenna resonating element, wherein the antenna resonating element is interposed between the parasitic element and the antenna ground; and an antenna feed coupled to the antenna resonating element, wherein the first and second openings are configured to disrupt a cavity resonance between the parasitic element and the antenna resonating element.

15. The antenna defined in claim 14, wherein the antenna resonating element comprises a third opening that intersects the second opening.

16. The antenna defined in claim 15, wherein the antenna resonating element comprises a fourth opening that intersects the first and third openings.

17. The antenna defined in claim 16, wherein the first opening extends parallel to the third opening, the second opening extends parallel to the fourth opening, and the first and third openings are oriented at a non-parallel angle with respect to the second and fourth openings.

18. The antenna defined in claim 16, wherein the third and fourth openings are configured to disrupt the cavity resonance between the parasitic element and the antenna resonating element.

19. The antenna defined in claim 14, wherein the parasitic element has a first opening, a second opening extending parallel to the first opening, a third opening, and a fourth opening extending parallel to the third opening.

* * * * *